US005369383A

United States Patent [19]

Takahashi et al.

[11] Patent Number: 5,369,383

[45] Date of Patent: Nov. 29, 1994

[54] STRIP LINE FILTER HAVING DUAL MODE LOOP RESONATORS

[75] Inventors: Kazuaki Takahashi, Kawasaki; Makoto Hasegawa, Tokyo; Mitsuo Makimoto, Yokohama; Munenori Fujimura, Kawasaki, all of Japan

[73] Assignee: Matsushita Electric Industrial Co., Ltd., Osaka, Japan

[21] Appl. No.: 53,535

[22] Filed: Apr. 29, 1993

[30] Foreign Application Priority Data

| | | | |
|---|---|---|---|
| Apr. 30, 1992 | [JP] | Japan | 4-111127 |
| May 11, 1992 | [JP] | Japan | 4-117111 |
| Jun. 12, 1992 | [JP] | Japan | 4-153238 |
| Sep. 14, 1992 | [JP] | Japan | 4-244374 |

[51] Int. Cl.[5] ..... H01P 1/203; H01P 7/08

[52] U.S. Cl. ..... 333/204; 333/219

[58] Field of Search ..... 333/204, 205, 219, 246, 333/235

[56] References Cited

U.S. PATENT DOCUMENTS

| | | | |
|---|---|---|---|
| 3,796,970 | 3/1974 | Snell, Jr. | 333/134 |
| 3,967,223 | 6/1976 | McAvoy | 333/219 |
| 4,327,342 | 4/1982 | De Ronde | 333/204 |
| 4,488,131 | 12/1984 | Griffin et al. | 333/205 |
| 5,172,084 | 12/1992 | Fiedziuszko et al. | 333/219 X |

FOREIGN PATENT DOCUMENTS

| | | | |
|---|---|---|---|
| 0532330 | 3/1993 | European Pat. Off. . | |
| 0253302 | 12/1985 | Japan | 333/204 |
| 61-251203 | 11/1986 | Japan . | |
| 62-298202 | 12/1987 | Japan . | |

OTHER PUBLICATIONS

"Miniature Dual Mode Microstrip Filters" by J. A. Curtis et al; 1991 IEEE MTT-S Digest; pp.443–446.

Materick, "Resonant Microstrip rings and dielectric material testing", Microwaves & RF: Apr. 1991, vol. 30, No. 4; pp. 95–102.

1990 IEEE MTT-S International Microwave Symposium-Digest, vol. 1; May 8-10, 1990, Dallas, US; IEEE, New York, US, 1990; X. H. Jiao et al.; "Microwave frequency agile active filters for MIC and MMIC applications" pp. 503–506.

20th European Microwave Conference, Sep. 10–13, 1990, Budapect, HU; Microwave Exhibitions and Publishers Ltd, Tunbridge Wells, GB, 1990; M. Guglielmi et al.: "Expermental investigation of dual-mode microstrip ring resonators" pp. 901–906.

IRE Transactions on Microwave Theory and Techniques, vol. 9, No. 7, Jul. 1961, New York, US; pp. 359–360; J. A. Kaiser "Ring network filter".

Electronics Letters, vol. 8, No. 12, 15 Jun. 1972, Stevenage GB, pp. 301–302, J. Wested et al. "Resonance splitting in nonuniform ring resonators".

*Primary Examiner*—Seungsook Ham

*Attorney, Agent, or Firm*—Lowe, Price, LeBlanc & Becker

[57] ABSTRACT

A strip dual mode loop resonator includes a loop-shaped strip line having a pair of straight strip lines arranged in parallel, an electric length of the loop-shaped strip line being equivalent to a wavelength of a microwave circulated in the loop-shaped strip line in two different directions according to a characteristic impedance of the loop-shaped strip line, and the straight strip lines being coupled to each other in electromagnetic coupling to change the characteristic impedance of the loop-shaped strip line. The microwave is transferred from an input strip line to the loop-shaped strip line through electromagnetic field induced by the microwave. Thereafter, the microwave is reflected in the straight strip lines of the loop-shaped strip line to produce reflected microwaves circulated in opposite directions. Thereafter, the reflected waves are resonated and filtered in dual mode in the loop-shaped strip line. Thereafter, the microwave formed of the reflected waves is transferred from the loop-shaped strip line to an output strip line through electromagnetic field induced by the microwave.

17 Claims, 10 Drawing Sheets

STRIP LINE FILTER HAVING DUAL MODE LOOP RESONATORS

BACKGROUND OF THE INVENTION

1. Field of the Invention

The present invention relates to a strip dual mode loop resonator utilized to resonate waves in frequency bands ranging from an ultra high frequency (UHF) band to a super high frequency (SHF) band, and relates to a band-pass filter composed of a series of resonators which is utilized as a communication equipment or measuring equipment.

2. Description of the Related Art

A half-wave length open end type of strip ring resonator has been generally utilized to resonate microwaves ranging from the UHF band to the SHF band. Also, a one-wave length strip rink resonator has been recently known. In the one-wave length strip ring resonator, no open end to reflect the microwaves is required because an electric length of the strip ring resonator is equivalent to one-wave length of the microwaves. Therefore, the microwaves are efficiently resonated because electric energy of time microwaves resonated is not lost in the open end.

In addition, in cases where a band-pass filter is composed of a plurality of strip ring resonators arranged in series, a strip dual mode ring resonator functioning as a two-stage filter is required to efficiently filter the microwave in the band-pass filter.

2-1. Previously Proposed Art

A first conventional resonator is described.

FIG. 1A is a plan view of a one-wave length strip ring resonator in which no open end is provided. FIG. 1B is a sectional view taken generally along the line I—I of FIG. 1A. Each of constitutional elements of the ring resonator shown in FIG. 1A is illustrated in FIG. 1B.

As shown in FIG. 1A, a one-wave length strip ring resonator 11 conventionally utilized is provided with an input strip line 12 in which microwaves are transmitted, a closed ring-shaped strip line 13 in which the microwaves transferred from the input strip line 12 are resonated, and an output strip line 14 to which the microwaves resonated in the strip ring 13 are transferred.

As shown in FIG. 1B, the input and output strip lines 12, 4 and the ring-shaped strip line 13 respectively consist of a strip conductive plate 15, a dielectric substrate 16 surrounding the strip conductive plate 15, and a pair of conductive substrates 17*a*, 17*b* sandwiching the dielectric substrate 16.

The ring-shaped strip line 13 has an electric length equivalent to a wavelength of the microwave. The electric length of the ring-shaped strip line 13 is determined by correcting a physical line length of the ring-shaped strip line 13 with a relative dielectric constant $\epsilon_r$ of the dielectric substrate 16.

The input strip line 12 is arranged at one side of the strip ring 13 and is coupled to the ring-shaped strip line 13 in capacitive coupling. That is, when the microwaves transmit through the input strip line 12, electric field is induced in a gap space between the input strip line 12 and the ring-shaped strip line 13. Therefore, the intensity of electric field in the ring-shaped strip line 18 is also increased at a coupling point P1 adjacent to the input strip line 12 to a maximum value.

The output strip line 14 is arranged at an opposite side of the strip ring 13. In other words, the output strip line 14 is spaced 180 degrees (a half-wave length of the microwaves) in the electric length apart from the input strip line 12. In this case, the intensity of the electric field in the ring-shaped strip line 13 is maximized at a coupling point P2 adjacent to the output strip line 14 because the output strip line 14 is spaced 180 degrees in the electric length apart from the input strip line 12. Therefore, the output strip line 14 is electrically coupled to the ring-shaped strip line 13 in capacitive coupling.

In the above configuration, when microwaves are transmitted in the input strip line 12, electric field is induced at a gap portion between the input strip line 12 and the ring-shaped strip line 13 by the microwaves. Therefore, the intensity of the electric field in the ring-shaped strip line 13 is maximized at the coupling point P1 adjacent to the input strip line 12. Thereafter, the electric field induced at the coupling point P1 is diffused into the ring-shaped strip line 13 as traveling waves. In other words, the microwaves are transferred from the input strip line 12 to the ring-shaped strip line 13. In this case, a part of the travelling waves are transmitted in a clockwise direction, and a remaining part of the travelling waves are transmitted in a counterclockwise direction. In cases where the wavelength of the microwaves is equivalent to the electric length of the ring-shaped strip line 13, the microwaves are resonated in the ring-shaped strip line 13. Therefore, the intensity of the microwaves in the ring-shaped strip line 13 is amplified.

Thereafter, the intensity of the electric field in the ring-shaped strip line 13 is maximized at the coupling point P2 adjacent to the output strip line 14 because the output strip line 14 is spaced 180 degrees in the electric length apart from the input strip line 12. Therefore, the electric field is induced at a gap space between the ring-shaped strip line 13 and the output strip line 14. As a result, the microwave resonated in the ring-shaped strip line 13 is transferred to the output strip line 14.

Accordingly, the strip ring resonator 11 functions as a resonator of the microwaves.

In this case, the microwaves can be resonated in the strip fine 13 even though the electric length of the ring-shaped strip line 13 is an integral multiple of the wavelength of the microwaves.

The strip ring resonator 11 is often utilized to estimate the dielectric substrate 16 because a resonance frequency (or a central frequency) of the microwaves is shifted according to a physical shape of the dielectric substrate 16 and the relative dielectric constant $\epsilon_r$ of the dielectric substrate 16.

The strip ring resonator 11 is described in detail in the literature "Resonant Microstrip Ring Aid Dielectric Material Testing", Microwaves & RF, page 95–102, April, 1991.

2-2. Another Previously Proposed Art

A second conventional resonator is described.

FIG. 2 is a plan view of a strip dual mode ring resonator functioning as a two-stage filter.

As shown in FIG. 2, a strip dual mode ring resonator 21 conventionally utilized is provided with an input strip line in which microwaves are transmitted, a one-wave length strip ring 23 electrically coupled to the input strip line 22 in capacitive coupling, and an output strip line 24 electrically coupled to the strip ring 23 in capacitive coupling.

The input strip line 22 is coupled to the strip ring 23 through a gap capacitor 25, and the output strip line 24 is coupled to the strip ring 23 through a gap capacitor 26. Also, the output strip line 24 is spaced 90 degrees (or a quarter-wave length of the microwaves) in the electric length apart from the input strip line 22.

The strip ring 23 has an open end stub 27 in which the microwaves are reflected. The open end stub 27 is spaced 135 degrees (or $\frac{3}{8}$-wave length of the microwaves) in the electric length apart from the input and output strip lines 22, 24.

In the above configuration, the action of the strip dual mode ring resonator 21 is qualitatively described in a concept of travelling waves.

When travelling waves are transmitted in the input strip line 22, electric field is induced in the gap capacitor 25. Therefore, the input strip line 22 is coupled to the strip ring 23 in the capacitive coupling, so that a strong intensity of electric field is induced at a point P3 of the strip ring 23 adjacent to the input strip line 22. That is, the travelling waves are transferred to the coupling point P3 of the strip ring 23. Thereafter, the travelling waves are circulated in the strip ring 23 to diffuse the electric field strongly induced in the strip ring 23. In this case, a part of the travelling waves are transmitted in a clockwise direction and a remaining part of the travelling waves are transmitted in a counterclockwise direction.

An action of the travelling waves transmitted in the counterclockwise direction is initially described.

When the travelling waves transmitted in the counterclockwise direction reach a coupling point P4 of the strip ring 23 adjacent to the output line 24, the phase of the travelling wave shifts by 90 degrees. Therefore, the intensity of the electric field at the coupling point P4 is minimized. Accordingly, the output strip line 24 is not coupled to the strip ring 23 so that the travelling waves are not transferred to the output strip line 24.

Thereafter, when the travelling waves reach the open end stub 27, the phase of the travelling wave further shifts by 135 degrees as compared with the phase of the travelling wave reaching the coupling point P4. Because the open end stub 27 is equivalent to a discontinuous portion of the strip ring 23, a part of the travelling waves are reflected at the open end stub 27 to produce reflected waves, and a remaining part of the travelling waves are not reflected at the open end stub 27 to produce non-reflected waves.

The non-reflected waves are transmitted to the coupling point P3. In this case, because the phase of the non-reflected waves transmitted to the coupling point P3 totally shifts by 360 degrees as compared with that of time travelling waves transferred from the input strip line 22 to the coupling point P3, the intensity of the electric field at the coupling point P3 is maximized. Therefore, the input strip line 22 is coupled to the strip ring 23 so that a part of the non-reflected waves are returned to the input strip line 22. A remaining part of the non-reflected waves are again circulated in the counterclockwise direction so that the microwaves transferred to the strip ring 23 are resonated.

In contrast, the reflected waves are returned to the coupling point P4. In this case, the phase of the reflected waves at the point P4 further shifts by 135 degrees as compared with that of the reflected wave at the open end stub 27. This is, the phase of the reflected wave at the point P4 totally shifts by 360 degrees as compared with that of the travelling waves transferred from the input strip line 22 to the coupling point P3. Therefore, the intensity of the electric field at the coupling point P4 is maximized, so that the output strip line 24 is coupled to the strip ring 23. As a result, a part of the reflected wave is transferred to the output strip line 24. A remaining part of the reflected wave is again circulated in the clockwise direction so that the microwave transferred to time strip ring 23 is resonated.

Next, the travelling waves transmitted in the clockwise direction is described.

A part of the travelling waves transmitted in the clockwise direction are reflected at the open end stub 27 to produce reflected waves when the phase of the travelling waves shifts by 135 degrees. Non-reflected waves formed of a remaining part of the travelling waves reach the coupling point P4. The phase of the non-reflected waves totally shifts by 270 degrees so that the intensity of the electric field induced by the non-reflected waves is minimized. Therefore, the non-reflected waves are not transferred to the output strip line 24. That is, a part of the non-reflected waves are transferred from the coupling point P3 to the input strip line 22 in the same manner, and a remaining part of the non-reflected waves are again circulated in the clockwise direction so that the microwave transferred to the strip ring 23 is resonated.

In contrast, the reflected waves are returned to the coupling point P3. In this case, because the phase of the reflected waves at the coupling point P3 totally shifts by 270 degrees, the intensity of the electric field induced by the reflected waves are minimized so that the reflected waves are not transferred to the input strip line 22. Thereafter, the reflected waves reach the coupling point P4. In this case, because the phase of the reflected waves at the coupling point P4 totally shifts by 360 degrees, the intensity of the electric field induced by the reflected waves is maximized. Therefore, a part of the reflected waves are transferred to the output strip line 24, and a remaining part of the reflected waves are again circulated in the counterclockwise direction so that the microwaves transferred to the strip ring 23 are resonated.

Accordingly, because the microwaves can be resonated in the strip ring 23 on condition that a wavelength of the microwaves equals the electric length of the strip ring 23, the strip dual mode ring resonator 21 functions as a resonator and a filter.

Also, the microwaves transferred from the input strip line 22 are initially transmitted in the strip ring resonator 23 as the non-reflected waves, and the microwaves are again transmitted in the strip ring resonator 23 as the reflected waves shifting by 90 degrees as compared with the non-reflected waves. In other words, two orthogonal modes formed of the non-reflected waves and the reflected waves independently coexist in the strip ring resonator 23. Therefore, the strip dual mode filter 21 functions as a dual mode filter. That is, the function of the strip dual mode filter 21 is equivalent to a pair of a single mode filters arranged in series.

In addition, a ratio in the intensity of the reflected waves to the non-reflected waves is changed in proportional to the length of the open end stub 27 projected in a radial direction of the strip ring resonator 23. Therefore, the intensity of the reflected microwave transferred to the output strip line 24 can be adjusted by trimming the open end stub 27.

The strip dual mode ring resonator 21 is proposed by J. A. Curtis "International Microwave Symposium Digest", IEEE, page 443–446(N-1), 1991.

2-3. Problems to be Solved by the Invention

However, there are many drawbacks in the strip ring resonator 11. That is, it is difficult to manufacture a small-sized strip ring resonator 11 because a central portion surrounded by the ring-shaped strip line 13 is a dead space. Also, the electric length of the ring-shaped strip line 13 cannot be minutely adjusted after the ring-shaped strip line 13 is manufactured according to a photo-etching process or the like. In this case, the resonance frequency of the microwaves depends on the electric length of the ring-shaped strip line 13. Therefore, the resonance frequency of the microwaves cannot be minutely adjusted. In addition, in cases where a plurality of strip ring resonators 11 are arranged in series to compose a band-pass filter, it is difficult to couple the ring-shaped strip lines 13 to each other because the ring-shaped strip lines 13 are curved.

Also, there are many drawbacks in the strip ring resonator 21. That is, a central frequency of the microwaves filtered in the strip ring resonator 21 cannot be minutely adjusted because the central frequency of the microwaves depends on the width of the open end stub 27 extending in a circumferential direction of the strip ring 23. Therefore, the central frequency of the microwaves manufactured does not often agree with a designed central frequency. As a result, a yield rate of the strip ring resonator 21 is lowered.

Also, because a resonance width (or a full width at half maximum) can be adjusted only by trimming the length of the open end stub 27, the resonance width cannot be enlarged. In other words, in cases where the width of the open end stub 27 in the circumferential direction is widened to enlarge the resonance width, the phase of the reflected waves reaching the output strip line 24 undesirably shifts. As a result, the intensity of the microwaves transferred to the output strip line 24 is lowered at the central frequency of the microwaves resonated. Accordingly, in cases where a plurality of strip ring resonators 21 are arranged in series to compose a band-pass filter, the filter is limited to a narrow passband type of filter.

SUMMARY OF THE INVENTION

A first object of the present invention is to provide, with due consideration to the drawbacks of such a conventional strip ring resonator, a strip dual mode loop resonator in which the central frequency of the microwave is minutely adjusted and the resonance width is widened, and to provide a band-pass filter composed of the resonators.

Also, a second object is to provide a small-sized strip dual mode loop resonator in which the resonance frequency is easily and minutely adjusted and the resonance width is narrow, and to provide a band-pass filter composed of the resonators.

The first object is achieved by the provision of a strip dual mode loop resonator in which microwave is resonated, comprising:

a loop-shaped strip line having a pair of parallel lines arranged in parallel to each other, an electric line length of the loop-shaped strip line being equivalent to a wavelength of the microwave to resonate the microwave circulated in the loop-shaped strip line in two difference directions according to a characteristic impedance of the loop-shaped strip line, and the parallel lines being coupled to each other in electromagnetic coupling to change the characteristic impedance of the loop-shaped strip line;

an input strip line in which the microwave is transmitted;

an input impedance element for coupling the input strip line to the loop-shaped strip line in electromagnetic coupling to transfer the microwave from the input strip line to an input point of the loop-shaped strip line;

an output strip line in which the microwave resonated in the loop-shaped strip line is transmitted; and an output impedance element for coupling the output strip line to the loop-shaped strip line in electromagnetic coupling to transmit the microwave from an output point of the loop-shaped strip line to the output strip line, the output point being spaced a quarter of the wavelength of the microwave apart from the input point.

In the above configuration, when the microwave is transmitted in the input strip line, electromagnetic field is induced by the microwave between the input strip line and the loop-shaped strip line. Therefore, the input strip line is coupled to the loop-shaped strip line by the action of the input impedance element, so that the microwave is transferred to the input point of the loop-shaped strip line.

Thereafter, the microwave is transmitted in the loop-shaped strip line in two diffferential directions such as a clockwise direction and a counterclockwise direction, according to the characteristic impedance of the loop-shaped strip line.

In this case, because the characteristic impedance of the loop-shaped strip line is changed by the electromagnetic coupling between the parallel lines of the loop-shaped strip line, the microwave is reflected in the parallel lines of loop-shaped strip line to produce reflected waves. The reflected waves are circulated in the loop-shaped strip line in the clockwise and counterclockwise directions. In this case, electromagnetic coupling strength between the parallel lines depends on the shape of the loop-shaped strip line such as a strip line width and a distance between the parallel lines.

Thereafter, because the electrical line length of the loop-shaped strip line is equivalent to the wavelength of the microwave, the microwave formed of the reflected waves is resonated in the loop-shaped strip line. In this case, a resonance width of the microwave resonated in the loop-shaped strip line depends on the electromagnetic coupling strength between the parallel lines. That is, the resonance width is varied depending on time shape of the loop-shaped strip line.

Thereafter, intensity of electric field or magnetic field is maximized by the reflected waves at the output point of the loop-shaped strip line. Therefore, the output strip line is coupled to the loop-shaped strip line by the action of the output impedance element. Thereafter, the microwave resonated in the loop-shaped strip line is transferred to the output strip line.

In contrast, intensity of electric field or magnetic field is minimized by the reflected waves at the input point of the loop-shaped strip line because the input point is spaced the quarter of the wavelength of the microwave apart from the output point. Therefore, the input strip line is not coupled to the loop-shaped strip line so that the microwave resonated in the loop-shaped strip line is not returned to the output strip line.

Accordingly, because the microwave is resonated in the loop-shaped strip line on condition that the wavelength of the microwave is equivalent to the line length of the loop-shaped strip line, the strip dual mode loop resonator functions as a resonator and a filter.

Also, because the microwave is initially circulated in the loop-shaped strip line as non-reflected waves, and the reflected waves shifted 90 degrees as compared with the non-reflected waves are again circulated in the loop-shaped strip line, two orthogonal modes formed of the non-reflected waves and the reflected waves independently coexist in the strip dual mode loop resonator. Therefore, the strip dual mode loop resonator operates in dual mode.

Also, because the parallel lines of the loop-shaped strip line are approached to each other to couple in the electromagnetic coupling, a space occupied by the loop-shaped strip line can be minimized. Therefore, a small-sized strip dual mode loop resonator can be manufactured. Also, a hollow space formed in the center of the loop-shaped strip line can be efficiently utilized for the electromagnetic coupling.

Also, because the resonance width of the microwave is varied depending on the shape of the loop-shaped strip line, the resonance width can be adjusted by changing the width of the loop-shaped strip line or the distance between the parallel lines.

It is preferred that the strip dual mode loop resonator additionally include a line-to-line impedance element arranged between the parallel lines of the loop-shaped strip line for changing the characteristic impedance of the loop-shaped strip line, a first electric line length between the input point and one end of the line-to-line impedance element connected to one of the parallel lines being equal to a second electric length between the output point and another end of the line-to-line impedance element connected to the other parallel line.

In the above configuration, the characteristic impedance of the loop-shaped strip line is changed by an impedance of the line-to-line impedance element. Thai; is, electromagnetic waves existing in the loop-shaped strip line exert influence on each other through the line-to-line impedance element.

Therefore, intensity of electric field or magnetic field induced by the microwave which is influenced by the line-to-line impedance element is maximized at the output point even though the microwave is not reflected in the parallel lines. Therefore, the resonance width of the microwave resonated is changed depending on the impedance of the line-to-line impedance element.

Accordingly, the resonance width of the micro wave resonated in the loop-shaped strip line can be suitably adjusted by changing the impedance of the line-to-line impedance element.

It is preferred that the strip dual mode loop resonator additionally include a capacitor having a variable capacitance for changing the characteristic impedance of the loop-shaped strip line, one end of the capacitor being connected to a connecting point of the loop-shaped strip line spaced a three-eighth of the wavelength of the microwave apart from the input and output points of the loop-shaped strip line, and another end of the capacitor being grounded.

In the above configuration, a central frequency of the microwave resonated in the loop-shaped strip line depends on both the impedance of the line-to-line impedance element and the variable capacitance of the capacitor.

Therefore, after the central frequency is roughly adjusted by adjusting both the impedance of the line-to-line impedance element and the variable capacitance of the capacitor, the central frequency can be minutely adjusted by adjusting the variable capacitance of the capacitor after the resonator is manufactured. Accordingly, a yield rate of the resonator can be increased because the central frequency and the resonance width can be adjusted after the resonator is manufactured.

It is preferred that the strip dual mode loop resonator additionally include an open end stub for reflecting the microwave to change the characteristic impedance of the loop-shaped strip line, the open end stub being spaced a three-eighth of the wavelength of the microwave apart from the input and output points of the loop-shaped strip line, and intensity of the microwave reflected by the open end stub being changed by trimming the open end stub.

In the above configuration, a central frequency of the microwave resonated in the loop-shaped strip line depends on both the impedance of the line-to-line impedance element and the intensity of the microwave reflected in the open end stub. The intensity of the microwave reflected in the open end stub is proportional to the length of the open end stub.

Therefore, after the central frequency is roughly adjusted by adjusting both the impedance of the line-to-line impedance element and the length of the open end stub, the central frequency can be minutely adjusted by trimming the open end stub after the resonator is manufactured. Accordingly, a yield rate of the resonator can be increased because the central frequency and the resonance width can be adjusted after the resonator is manufactured.

It is preferred that the input impedance element be an input coupling capacitor for coupling the input strip line to the loop-shaped strip line in capacitive coupling, and the output impedance element be an output coupling capacitor for coupling the output strip line to the loop-shaped strip line in capacitive coupling.

In the above configuration, when the microwave is transmitted in the input strip line, electric field is induced in the input coupling capacitor. Therefore, intensity of electric field at the input point of the loop-shaped strip line is maximized by the action of the electric field induced in the input coupling capacitor. In other words, the microwave in the input strip line is transferred to the loop-shaped strip line. The input point is positioned at the loop-shaped strip line adjacent to the input strip line.

Also, when the microwave reflected by the line-to-line impedance element and the electromagnetic coupling between the straight lines is resonated in the loop-shaped strip line, intensity of electric field in the loop-shaped strip line is maximized at the output point. The output point is positioned at the loop-shaped strip line adjacent to the output strip line. Therefore, electric field is induced in the output coupling capacitor, so that the output strip line is coupled to the loop-shaped strip line in the capacitive coupling. As a result, the microwave resonated in the loop-shaped strip line is transferred to the output strip line.

It is preferred that the input impedance element be an input magnetic coupling line for coupling the input strip line to the loop-shaped strip line in magnetic coupling, and the output impedance element be an output magnetic coupling line for coupling the output strip line to the loop-shaped strip line in magnetic coupling.

In the above configuration, when the microwave is transmitted in the input strip line, magnetic field is induced in the input magnetic coupling line. Therefore, intensity of magnetic field in the loop-shaped strip line is maximized at the input point because the magnetic field is induced in the loop-shaped strip line by the action of the magnetic field. In other words, the microwave in the input strip line is transferred to the loop-shaped strip line. The input point is positioned at the loop-shaped strip line adjacent to the input strip line.

Also, when the microwave reflected by the line-to-line impedance element and the electromagnetic coupling between the straight lines is resonated in the loop-shaped strip line, intensity of magnetic field in the loop-shaped strip line is maximized at the output point. The output point is positioned at the loop-shaped strip line adjacent to the output strip line, Therefore, magnetic field is induced in the output strip line by the action of the output magnetic coupling line, so that the output strip line is coupled to the loop-shaped strip line in the magnetic coupling. As a result, the microwave resonated in the loop-shaped strip line is transferred to the output strip line.

Also, the first object is achieved by the provision of a strip dual mode loop resonator in which microwave is resonated, comprising:

a loop-shaped strip line having a pair of parallel lines arranged in parallel to each other, a line length of the loop-shaped strip line being equal to a wavelength of the microwave to resonate the microwave which is circulated in the loop-shaped strip line in two difference directions according to a characteristic impedance of the loop-shaped strip line, and the parallel lines being coupled to each other in electromagnetic coupling to change the characteristic impedance of the loop-shaped strip line;

an input strip line in which the microwave is transmitted;

an input impedance element for coupling the input strip line to the loop-shaped strip line in electromagnetic coupling to transmit the microwave From the input strip line to an input point of the loop-shaped strip line;

an output strip line in which the microwave resonated in the loop-shaped strip line is transmitted;

an output impedance element for coupling the output strip line to the loop-shaped strip line in electromagnetic coupling to transmit the microwave from an output point of the loop-shaped strip line to the output strip line, the output point of the loop-shaped strip line being spaced a half of the wavelength of the microwave apart from the input point of the loop-shaped strip line;

a line-to-line impedance element arranged between the parallel lines of the loop-shaped strip line for changing the characteristic impedance of the loop-shaped strip line, one end of the line-to-line impedance element connected to one of the parallel lines being spaced a quarter of the wavelength of the microwave apart from the input point of the loop-shaped strip line, and another end of the line-to-line impedance element connected to the other parallel line being positioned to the output point of the loop-shaped strip line.

In the above configuration, the microwave is transferred from the input strip line to the input point of the loop-shaped strip line because the lines are coupled to each other by the action of the input impedance element. Thereafter, because the characteristic impedance of the loop-shaped strip line is changed by time electromagnetic coupling between the parallel lines of the loop-shaped strip line and the line-to-line impedance element, the microwave is reflected to produce reflected waves. The reflected waves are resonated in the loop-shaped strip line. Thereafter, intensity of electric field or magnetic field is maximized at the output point of the loop-shaped strip line. Therefore, the output strip line is coupled to the loop-shaped strip line in the electromagnetic coupling by the action of the output impedance element. Thereafter, the microwave resonated in the loop-shaped strip line is transferred to the output strip line.

Accordingly, even though the output strip line is spaced a half wavelength of the microwave apart from the input strip line, the strip dual mode loop resonator functions as a filter and resonator in dual mode.

Also, a resonance width of the microwave resonated in the loop-shaped strip line can be set by providing the line-to-line impedance element.

Also, the first object is achieved by the provision of a band-pass filter for filtering microwave, comprising:

a plurality of loop-shaped strip lines arranged in series, each of the loop-shaped strip lines having a pair of parallel lines arranged in parallel to each other, an electric line length of each of the loop-shaped strip line being equivalent to a wavelength of the microwave to resonate the microwave circulated in the loop-shaped strip line in two difference directions according to a characteristic impedance of the loop-shaped strip line, and the parallel lines of each of the loop-shaped strip line being coupled to each other in electromagnetic coupling to change the characteristic impedance of each of the loop-shaped strip lines;

an input strip line in which the microwave is transmitted;

an input impedance element for coupling the input strip line to the loop-shaped strip line arranged in a first stage in electromagnetic coupling to transfer the microwave from the input strip line to an input point of the first-stage loop-shaped strip line;

a plurality of inter-stage impedance elements which each are arranged between a pair of loop-shaped strip lines;

an output strip line in which the microwave resonated in the loop-shaped strip lines is transmitted;

an output impedance element for coupling the output strip line to the loop-shaped strip line in a final stage in electromagnetic coupling to transmit the microwave from an output point of the final-stage loop-shaped strip line to the output point, the output point being spaced a quarter of the wavelength of the microwave apart from the input point in each of the loop-shaped strip lines; and a plurality of line-to-line Impedance elements respectively arranged between the parallel lines of each of the loop-shaped strip lines for changing the characteristic impedance of each of the loop-shaped strip lines, each of the line-to-line impedance elements being positioned at equal intervals from both the input point and the output point.

In the above configuration, the loop-shaped strip lines are arranged in series. Also, each of the loop-shaped strip lines functions as a filter and resonator in dual mode. Accordingly, the band-pass filter functions as a multistage filter in which the number of stages is twice as many as the number of loop-shaped strip lines.

Also, the band-pass filter functions as a multistage resonator in which a resonance width of the microwave can be adjusted.

Also, the first object is achieved by the provision of a strip dual mode loop resonator in which microwave is resonated, comprising:

a loop-shaped strip line having an electric length $\theta_L=360$ degrees equivalent to a wavelength of the microwave to resonate the microwave circulated therein in two difference directions according to a line impedance thereof, the loop-shaped strip line comprising a pair of parallel lines which are arranged in parallel to each other and are coupled to each other in electromagnetic coupling, the parallel lines respectively having an electric length $\theta 1$ degrees ($\theta 1<90$ degrees) and a line impedance Z1, a first side strip line through which first side ends of the parallel lines are connected, the first side strip line having an electric length $\theta 2$ degrees ($\theta 2>90$ degrees) and a line impedance Z2 differing from the line impedance Z1, and a second side strip line through which second side ends of the parallel lines are connected, the second side strip line having an electric length $\theta 3$ degrees ($\theta 3=360-2*\theta 1-\theta 2$) and a line impedance Z3 differing from the line impedance Z1;

an input strip line in which the microwave is transmitted;

an input impedance element for coupling the input strip line to the first side strip line of the loop-shaped strip line in electromagnetic coupling to transfer the microwave from the input strip line to an input point of the first side strip line;

an output strip line in which the microwave resonated in the loop-shaped strip line is transmitted; and an output impedance element for coupling the output strip line to the first side strip line of the loop-shaped strip line in electromagnetic coupling to transfer the microwave from an output point of the first side strip line to the output strip line, the output point of the first side strip line being spaced 90 degrees in the electric length apart from the input point of the first side strip line.

In the above configuration, when the microwave is transmitted in the input strip line, electromagnetic field is induced by the microwave between the input strip line and the loop-shaped strip line. Therefore, the input strip line is coupled to the first side strip line of the loop-shaped strip line by the action of the input impedance element, so that the microwave is transferred to the input point of the first side strip line.

Thereafter, the microwave is transmitted in the loop-shaped strip line in two differential directions such as a clockwise direction and a counterclockwise direction, according to the line impedance of the loop-shaped strip line.

In this case, because the line impedance Z1 of the parallel lines in the loop-shaped strip line differ from the line impedance Z2 of the first and second side strip lines, and because the parallel lines are coupled to each other in the electromagnetic coupling, the microwave is reflected in the loop-shaped strip line to produce reflected waves. The reflected waves are transmitted in the clockwise and counterclockwise directions. Thereafter, because the electrical line length of the loop-shaped strip line is equivalent to the wavelength of the microwave, the microwave formed of the reflected waves is resonated in the loop-shaped strip line. In this case, intensity of electric field or magnetic field is maximized by the reflected waves at the output point of the first side strip line. Therefore, the output strip line is coupled to the first side strip line by the action of the output impedance element. Thereafter, the microwave resonated in the loop-shaped strip line is transferred to the output strip line. In this case, when a difference in the line impedance between the parallel line and the first or second side strip line is changed, a resonance width of the microwave resonated is also changed.

In contrast, intensity of electric field or magnetic field is minimized by the reflected waves at the input point of the first side strip-line. Therefore, the input strip line is not coupled to the first side strip line so that the microwave resonated in the loop-shaped strip line is not returned to the input strip line.

Accordingly, because the microwave is resonated in the loop-shaped strip line on condition that the wavelength of the microwave is equivalent to the line length of the loop-shaped strip line, the strip dual mode loop resonator functions as a resonator and a filter.

Also, because the microwave is initially circulated in the loop-shaped strip line as non-reflected waves, and the reflected waves shifted 90 degrees as compared with the non-reflected waves are again circulated in the loop-shaped strip line, two orthogonal modes formed of the non-reflected waves and the reflected waves independently coexist in the strip dual mode loop resonator. Therefore, the strip dual mode loop resonator operates in dual mode.

Also, because the parallel lines of the loop-shaped strip line are approached to each other to couple in the electromagnetic coupling, a space occupied by the loop-shaped strip line can be minimized. Therefore, a small-sized strip dual mode loop resonator can be manufactured. Also, a hollow space formed in the center of the loop-shaped strip line can be efficiently utilized for the electromagnetic coupling.

Also, the resonance width of the micro wave resonated in the loop-shaped strip line can be adjusted by changing the line impedances Z1, Z2, Z3 in the loop-shaped strip line.

It is preferred that the strip dual mode loop resonator additionally include an open end stub for reflecting the microwave to change the line impedance of the loop-shaped strip line, the open end stub being arranged at a middle point of the second side strip line to be spaced a three-eighth of the wavelength of the microwave apart from the input and output points of the first side strip line, and intensity of the microwave reflected by the open end stub being changed by trimming the open end stub.

In the above configuration, a central frequency of the microwave resonated in the loop-shaped strip line depends on both the line impedance Z1 of the parallel lines and the intensity of the microwave reflected in the open end stub. The intensity of the microwave reflected in the open end stub is proportional to the length of the open end stub.

Therefore, after the central frequency is roughly adjusted by adjusting both the line impedance Z1 of the parallel lines and the length of the open end stub, the central frequency can be minutely adjusted by trimming the open end stub after the resonator is manufactured. Accordingly, a yield rate of the resonator can be increased because the central frequency and the resonance width can be adjusted after the resonator is manufactured.

It is preferred that the strip dual mode loop resonator additionally include a capacitor having a variable capacitance for changing the line impedance of the loop-shaped strip line, one end of the capacitor being connected to a middle point of the second side strip line to be spaced a three-eighth of the wavelength of the microwave apart from the input and output points of the loop-shaped strip line, and another end of the capacitor being grounded.

In the above configuration, a central frequency of the microwave resonated in the loop-shaped strip line depends on both the line impedance Z1 of the parallel lines and the variable capacitance of the capacitor.

Therefore, after the central frequency is roughly adjusted by adjusting both the line impedance Z1 of the parallel lines and the variable capacitance of the capacitor, the central frequency can be minutely adjusted by adjusting the variable capacitance of the capacitor after the resonator is manufactured. Accordingly, a yield rate of the resonator can be increased because the central frequency and the resonance width can be adjusted after the resonator is manufactured.

Also, the first object is achieved by the provision of a band-pass filter for filtering micro,rave, comprising:

a plurality of loop-shaped strip lines arranged in series, each of the loop-shaped strip lines having an electric length $\theta_L=360$ degrees equivalent to a wavelength of the microwave to resonate the microwave circulated therein in two difference directions according to a line impedance thereof, each of the loop-shaped strip lines comprising a pair of parallel lines which are arranged in parallel to each other and are coupled to each other in electromagnetic coupling, the parallel lines respectively having an electric length $\theta 1$ degrees ($\theta 1<90$ degrees) and a line impedance Z1, a first side strip line through which first side ends of the parallel lines are connected, the first side strip line having an electric length $\theta 2$ degrees ($\theta 2>90$ degrees) and a line impedance Z2 differing from the line impedance Z1, and a second side strip line through which second side ends of the parallel lines are connected, the second side strip line having an electric length $\theta 3$ degrees ($\theta 3=360-2*\theta 1-\theta 2$) and a line impedance Z3 differing from the line impedance Z1;

an input strip line in which the microwave is transmitted;

an input impedance element for coupling the input strip line to the first side strip line of the loop-shaped strip line arranged in a first stage in electromagnetic coupling to transfer the microwave from the input strip line to an input point of the first side strip line;

a plurality of inter-stage impedance elements which each are arranged between a pair of loop-shaped strip lines;

an output strip line in which the microwave resonated in the loop-shaped strip line is transmitted; and an output impedance element for coupling the output strip line to the first side strip line of the loop-shaped strip line arranged in a final stage in electromagnetic coupling to transfer the microwave from an output point of the first side strip line to the output strip line, the output point of the first side strip line being spaced 90 degrees in the electric length apart from the input point of the first side strip line in each of the loop-shaped strip lines.

In the above configuration, the loop-shaped strip lines are arranged in series. Also, each of the loop-shaped strip lines functions as a filter and resonator in dual mode. Accordingly, the band-pass filter functions as a multistage filter in which the number of stages is twice as many as the number of loop-shaped strip lines.

Also, the band-pass filter functions as a multistage resonator in which a resonance width of the microwave can be adjusted.

The second object is achieved by the provision of a strip loop resonator in which microwave is resonated, comprising:

a rectangle-shaped strip line having an electric length shorter than a wavelength of the microwave for resonating the microwave circulated therein in two difference directions according to a line impedance thereof, the rectangle-shaped strip line comprising a pair of parallel coupling lines respectively having a wide width which are arranged in parallel to each other and are coupled to each other in capacitive coupling to change a characteristic impedance of the rectangle-shaped strip line, a first side strip line through which first side ends of the parallel lines are connected, the first side strip line having a narrow width narrower than the wide width of the parallel coupling lines, and a second side strip line through which second side ends of the parallel lines are connected, the second side strip line having another narrow width narrower than the wide width of the parallel coupling lines, an input strip line coupled to the rectangle-shaped strip line in electromagnetic coupling, the microwave being transferred from the input strip line to the rectangle-shaped strip line; and an output strip line coupled to the rectangle-shaped strip line in electromagnetic coupling, the microwave being transferred from the rectangle-shaped strip line to the output strip line.

In the above configuration, a microwave having a specific wavelength is transferred from the input strip line to the rectangle-shaped strip line. An electric length of the rectangle-shaped strip line is shorter than the specific wavelength of the wave length. However, because the parallel coupling lines of the rectangle-shaped strip line is strongly coupled to each other, a resonance wavelength of the microwave is longer than the electric length of the rectangle-shaped strip line. Therefore, the microwave having the specific wavelength is resonated in the rectangle-shaped strip line by adjusting the strength of the capacitive coupling between the parallel coupling lines when the microwave is circulated in the clockwise and counterclockwise directions.

During the resonance of the microwave, an unloaded quality factor Q becomes large because the parallel coupling lines of the rectangle-shaped strip line is strongly coupled to each other. Therefore, a resonance width of the microwave is narrowed.

Thereafter, the microwave resonated in the rectangle-shaped strip line is transferred to the output strip line.

Accordingly, because the microwave having the specific wavelength is circulated in the clockwise and counterclockwise directions and is resonated, the strip loop resonator functions as a resonator and filter.

Also, because the unloaded quality factor Q becomes large, the resonance width of the microwave is narrowed.

Also, because the microwave is resonated in the rectangle-shaped strip line even though the specific wavelength of the microwave is longer than the electric length of the rectangle-shaped strip line, the strip loop resonator can be minimized.

Also, because a resonance frequency of the microwave depends on the strength of the capacitive coupling between the parallel coupling lines, the resonance frequency can be minutely adjusted by trimming the parallel coupling lines.

Also, because the rectangle-shaped strip line is in rectangular shape, a large number of rectangle-shaped strip lines can be orderly arranged to form a multistage filter. Also, because the rectangle-shaped strip line is in rectangular shape, a pair of rectangle-shaped strip lines can be easily coupled to each other in capacitive or inductive coupling.

Also, the second object is achieved by the provision of a strip loop resonator in which microwave is resonated, comprising:

a loop-shaped strip line having an electric length shorter than a wavelength of the microwave to resonate the microwave circulated therein in two difference directions according to a line impedance thereof, the loop-shaped strip line comprising a pair of parallel coupling lines respectively having a narrow width which are arranged in parallel to each other and are coupled to each other in inductive coupling to change a characteristic impedance of the loop-shaped strip line, a first side strip line through which first side ends of the parallel lines are connected, the first side strip line having the narrow width, and a second side strip line through which second side ends of the parallel lines are connected, the second side strip line having the narrow width, an input strip line coupled to the loop-shaped strip line in electromagnetic coupling, the microwave being transferred from the input strip line to The loop-shaped strip line; and an output strip line coupled to the loop-shaped strip line in electromagnetic coupling, the microwave being transferred from the loop-shaped strip line to the output strip line.

In the above configuration, a microwave having a specific wavelength is transferred from the input strip line to the loop-shaped strip line. An electric length of the loop-shaped strip line is shorter than the specific wavelength of the wave length. However, because the parallel coupling lines of the loop-shaped strip line is strongly coupled to each other in the inductive coupling, a resonance wavelength of the microwave is longer than the electric length of the loop-shaped strip line. Therefore, the microwave having the specific wavelength is resonated in the loop-shaped strip line by adjusting the strength of the inductive coupling between the parallel coupling lines when the microwave is circulated in the clockwise and counterclockwise directions.

During the resonance of the microwave, an unloaded quality factor Q becomes large because the parallel coupling lines of the loop-shaped strip line is strongly coupled to each other. Therefore, a resonance width of the microwave is narrowed.

Thereafter, the microwave resonated in the loop-shaped strip line is transferred to the output strip line.

Accordingly, because the unloaded quality factor Q becomes large, the resonance width of the microwave is narrowed.

Also, because the microwave is resonated in the loop-shaped strip line even though the specific wavelength of the microwave is longer than the electric length of the loop-shaped strip line, the strip loop resonator can be minimized.

Also, because a resonance frequency of the microwave depends on the strength of the capacitive coupling between the parallel coupling lines, the resonance frequency can be minutely adjusted by trimming the parallel coupling lines.

Also, the second object is achieved by the provision of a band-pass filter for filtering microwave, comprising:

a plurality of rectangle-shaped strip lines coupled in series which each comprise a pair of parallel coupling lines respectively having a wide width which are arranged in parallel to each other and are coupled to each other in capacitive coupling to change a characteristic impedance of the rectangle-shaped strip line, a first side strip line having a narrow width through which first side ends of the parallel lines are connected, and a second side strip line having another narrow width through which second side ends of the parallel lines are connected, each of the rectangle-shaped strip lines having an electric length shorter than a wavelength of the microwave to resonate the microwave circulated therein in two difference directions according to a line impedance thereof;

an input strip line coupled to the rectangle-shaped strip line in a first stage, the microwave being transferred from the input strip line to the rectangle-shaped strip line in the first stage; and an output strip line coupled to the rectangle-shaped strip line in a final stage, the microwave being transferred from the rectangle-shaped strip line in the final stage to the output strip line.

In the above configuration, the rectangle-shaped strip lines are coupled in series. Also, the rectangle-shaped strip lines can be closely arranged. Accordingly, a large number of rectangle-shaped strip lines can be easily coupled in the capacitive or inductive coupling.

In addition, the microwave having a specific wavelength is resonated even though the specific wavelength of the microwave is longer than the electric length of each of the rectangle-shaped strip lines. Accordingly, the band-pass filter can be minimized.

BRIEF DESCRIPTION OF THE DRAWINGS

The objects, features and advantages of the present invention will be apparent from the following description taken in conjunction with the accompanying drawings, in which.

DETAIL DESCRIPTION OF THE PREFERRED EMBODIMENTS

Preferred embodiments of a strip dual mode loop resonator and a band-pass filter composed of the resonators according to the present invention are described with reference to drawings.

Figure 1A:
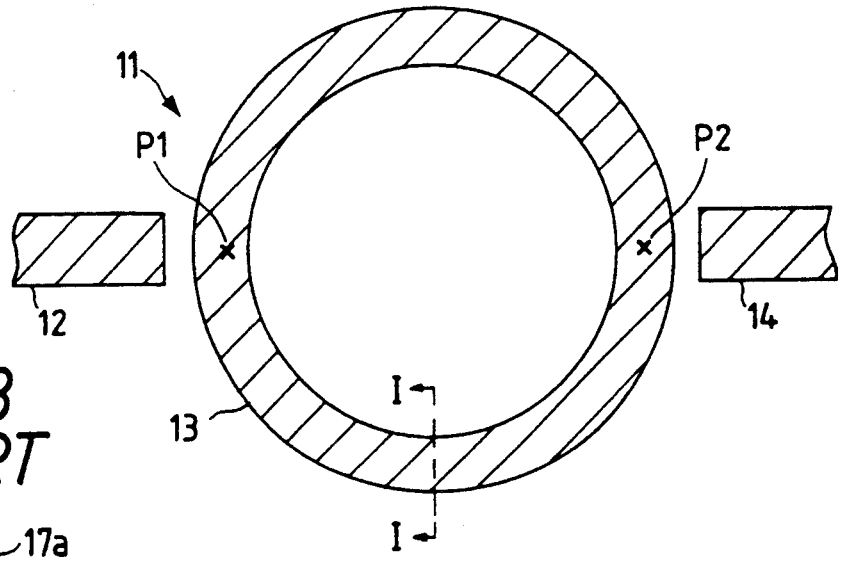
FIG. 1A PRIOR ART
FIG. 1A is a plan view of a conventional one-wave length type of strip ring resonator in which no open end is provided.
Figure 1B:
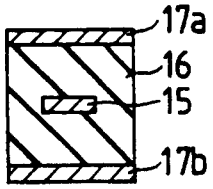
FIG. 1B PRIOR ART
FIG. 1B is a sectional view taken generally along the line I—I of FIG. 1A.
Figure 2:
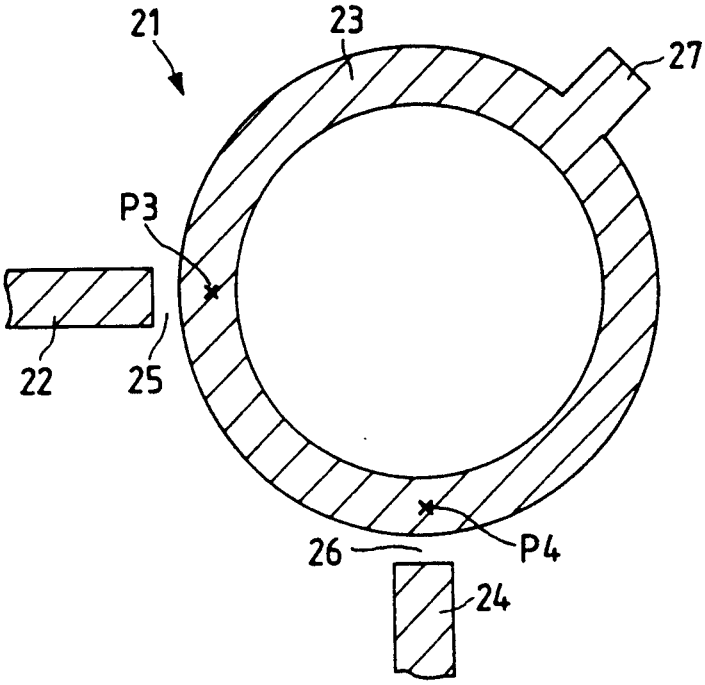
FIG. 2 PRIOR ART
FIG. 2 is a plan view of a conventional strip dual mode rink resonator functioning as a two-stage filter.
Figure 3A:
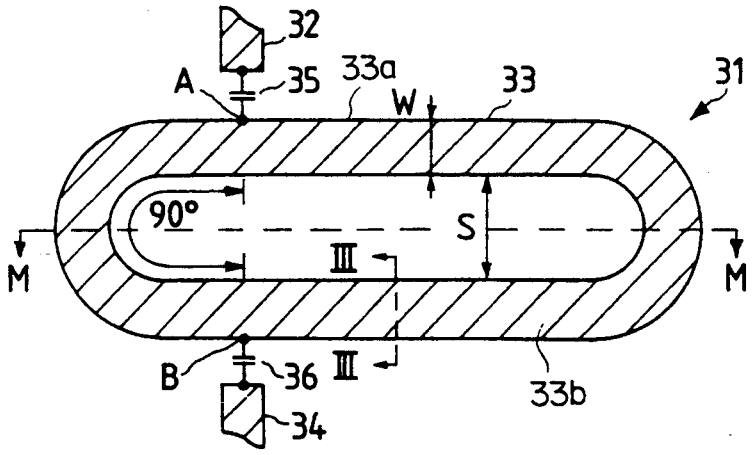
FIG. 3A is a plan view of a strip dual mode loop resonator according to a first embodiment of a first concept.
Figure 3C:
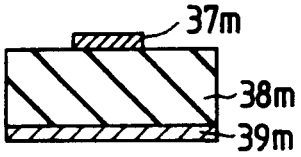
FIG. 3C is a sectional view taken generally along the line III—III of FIG. 3A according to a modification of the first concept.
Figure 3B:
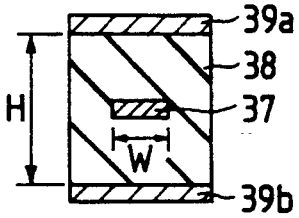
FIG. 3B is a sectional view taken generally along the line III—III of FIG. 3A according to the first embodiment.

FIG. 3A is a plan view of a strip dual mode loop resonator according to a first embodiment of a first concept. FIG. 3B is a sectional view taken generally along the line III—III of FIG. 3A.

As shown in FIG. 3A, a strip dual mode loop resonator 31 comprises an input strip line 32 in which microwaves are transmitted, a loop-shaped strip line 33 having a uniform line impedance in which the microwaves transferred from the input strip line 32 are resonated, an output strip line 34 to which the microwaves resonated in the loop-shaped strip line 33 are transferred, an input coupling capacitor 35 for coupling the input strip line 32 to the loop-shaped strip line 33 in capacitive coupling to transfer the microwaves from the input strip line 32 to the loop-shaped strip line 33, and an output coupling capacitor 36 for coupling the loop-shaped strip line 33 to the output strip line 34 in capacitive coupling to transfer the microwaves from the loop-shaped strip line 33 to the output strip line 34.

As shown in FIG. 3B, the loop-shaped strip line comprises a strip conductive plate 37, a dielectric substrate 38 having a relative dielectric constant $\epsilon_r$ and surrounding the strip conductive plate 37, and a pair of conductive substrates 39*a*, 39*b* sandwiching the dielectric substrate 38. Therefore, when the microwaves transmit through the loop-shaped strip line 33, electromagnetic field is induced in the dielectric substrate 38 between the strip conductive plate 37 and the conductive substrates 39*a*, 39*b*. That is, the loop-shaped strip line 33 is formed of a balanced strip line.

Also, the input and output strip lines 32, 34 are composed of the strip conductive plate 37, the dielectric substrate 38, and the conductive substrates 39*a*, 39*b* in the same manner as the loop-shaped strip line 33.

The first concept is not limited to the balanced strip line. That is, it is allowed that the input and output strip lines 32, 34 and the loop-shaped strip line 33 be respectively formed of a microstrip line shown in FIG. 3C. As shown in FIG. 3C, each of the strip lines 32, 33, and 34 comprises a strip conductive plate 37*m*, a dielectric substrate 38*m* mounting the strip conductive plate 37*m*, and a conductive substrate 39*m* mounting the dielectric substrate 38*m*.

An electric length of the loop-shaped strip line 33 is equivalent to a resonance wavelength $\lambda_o$, and the electric length of the loop-shaped strip line 33 is determined by correcting a physical line length of the loop-shaped strip line 33 with the relative dielectric constant $\epsilon_r$ of the dielectric substrate 38. In this specification, the length of the loop-shaped strip line 33 equivalent to the resonance wavelength $\lambda_o$ is called 360 degrees in the electric length for convenience because the microwaves are resonated in the strip line 33 in cases where the microwaves have a resonance angular frequency $\omega_o$ relating to the resonance wavelength $\lambda_o$.

The loop-shaped strip line 33 has a pair of straight strip lines 33*a*, 33*b* arranged in parallel to each other. Also, a width of the loop-shaped strip line 33 is W, and a height of the loop-shaped strip line 33 is H. The straight strip lines 33*a*, 33*b* are spaced a distance S apart from each other. Therefore, the straight strip lines 33*a*, 33*b* are coupled to each other in electromagnetic coupling according to a relative width W/H and a relative distance S/H. In other words, first electromagnetic field induced by the microwaves transmitting through the straight strip line 33*a* and second electromagnetic field induced by the microwaves transmitting through the straight strip line 33*b* exert influence on each other. Accordingly, a characteristic impedance of the loop-shaped strip line 38 differs from that of a ring-shaped strip line in which no straight strip lines arranged in parallel to each other are provided.

The input and output coupling capacitors 35, 36 are respectively formed of a plate capacitor having a lumped capacitance Cc. One end of the input coupling capacitor 35 is connected to an input point A of the straight strip line 33*a*, and one end of the output coupling capacitor 36 is connected to an output point B of the straight strip line 33*b*. The output point B is spaced 90 degrees (or a quarter-wave length of the microwaves) in the electric length apart from the input point A, and the input and output points A, B are symmetrically arranged each other with respect to a middle line M positioned between the straight strip lines 33*a*, 33*b*.

In the above configuration, when microwaves having various wavelengths around the resonance wavelength $\lambda_o$ are transmitted in the input strip line 32, electric field is strongly and locally induced in the the loop-shaped strip line 33 adjacent to the input strip line 32 because lumped electric field is induced in the input coupling capacitor 35 by the microwaves. Therefore, the microwaves in the input strip line 32 are transferred to the strip line 33.

Thereafter, to diffuse the electric field locally induced in the loop-shaped strip line 33, the microwaves transmit through the strip line 33 in clockwise and counterclockwise directions in the strip line 33 having the uniform line impedance. In this case, because the straight strip lines 33*a*, 33*b* of the strip line 33 are coupled to each other in the electromagnetic coupling, a part of the microwaves are reflected in the straight strip lines 33*a*, 33*b* to produce reflected waves. The reflected waves are circulated in the strip line 33 in the clockwise and counterclockwise directions. In cases where the wavelength of the microwaves agrees with the resonance wavelength $\lambda_o$, the microwaves are resonated in the strip line 33 according to the characteristic impedance of the strip line 33. The characteristic impedance of the strip line 33 is determined according to the uniform line impedance of the strip line 33 and the electromagnetic coupling between the straight strip lines 33*a*, 33*b* of the strip line 33. In contrast, in cases where the wavelength of the microwaves does not agree with the resonance wavelength $\lambda_o$, the microwaves are disappeared in the strip line 33. The resonance wavelength $\lambda_o$ is intrinsically determined according to the electric length of the strip line 33.

In this case, a resonance width (or a full width at half maximum) of the microwaves resonated in the strip line 33 is adjusted by changing the intensity of the electromagnetic coupling between the straight strip lines 33*a*, 33*b*. The intensity of the electromagnetic coupling depends on the relative dielectric constant $\epsilon_r$ of the dielectric substrate 38, the relative width W/H, and the relative distance S/H.

Thereafter, intensity of the electric field in the loop-shaped strip line 33 adjacent to the output strip line 34 is maximized by the reflected waves. Therefore, the microwaves in the strip line 33 is transferred to the output strip line 34 because the strip line 33 is coupled to the output strip line 34 according to the capacitive coupling.

Accordingly, because the microwaves are resonated in the strip line 33 on condition that the wavelength of the microwaves agrees with the resonance wavelength $\lambda_o$, the strip dual mode loop resonator 31 functions as a resonator and filter.

Also, the microwaves transferred from the input strip line 32 are initially transmitted in the loop-shaped strip line 33 as non-reflected waves, and the microwaves are again transmitted in the loop-shaped strip line 33 as the reflected waves shifting by 90 degrees as compared with the non-reflected waves. In other words, two orthogonal modes formed of the non-reflected waves and the reflected waves independently coexist in the strip dual mode loop resonator 31. Therefore, the strip dual mode loop resonator 31 functions as a two-stage filter in the same manner as the conventional strip dual mode ring resonator 21.

Next, frequency characteristics of the microwaves filtered in the strip line 33 are described to show a relationship between the resonance width of the microwaves resonated in the strip line 33 and the relative distance S/H.

Figure 4:
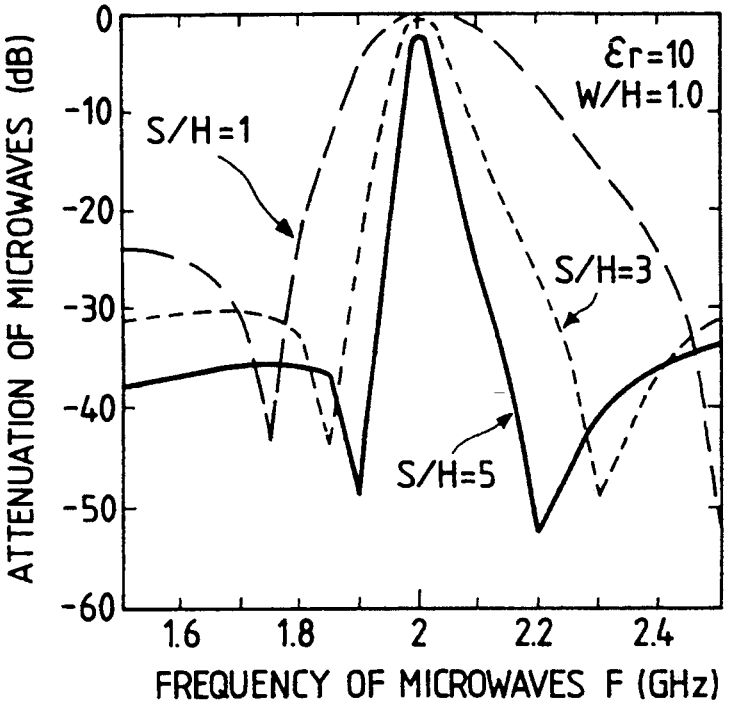
FIG. 4 shows frequency characteristics of the microwaves filtered in the strip dual mode loop resonator shown in FIG. 3.

FIG. 4 shows frequency characteristics of the microwaves filtered in the strip dual mode loop resonator 31 shown in FIG. 3.

As shown in FIG. 4, the intensity of the microwaves filtered in the strip dual mode loop resonator 31 is varied according to a frequency F(GHz) of the microwaves. Also, the resonance width $\Delta\omega$ of the microwaves is varied depending on the shape of the strip dual mode loop resonator 31 and the relative dielectric constant $\epsilon_r$ of the dielectric substrate 38. The shape is specified by the relative distance S/H and the relative width W/H.

In cases where the relative dielectric constant $\epsilon_r = 10$ and the relative width W/H = 1.0 are satisfied, a central frequency $\omega_o$ (or a resonance frequency $\omega_o$ relating to the resonance wave length $\lambda_o$) of the microwaves is fixed to 2 GHz. Also, the resonance width $\Delta\omega$ of the microwaves is narrowed in proportion as the relative distance S/H is increased.

For example, a relative band width $\Delta\omega/\omega_o$ defined by a ratio of the resonance width $\Delta\omega$ to the central frequency $\omega_o$ ranges from 0.02 to 0.1 when the relative distance S/H is changed from S/H = 5 to S/H = 1.

Accordingly, the resonance width $\Delta\omega$ of the microwaves can be suitably adjusted by changing the shape of the strip dual mode loop resonator 31 specified by the relative distance S/H and the relative width W/H.

Next, a second embodiment of the first concept according to the present invention is described.

Figure 5:
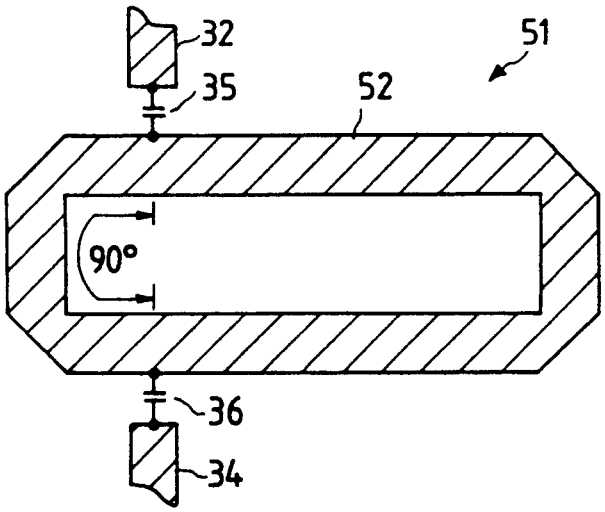
FIG. 5 is a plan view of a strip dual mode loop resonator according to a second embodiment of the first concept.

FIG. 5 is a plan view of a strip dual mode loop resonator according to a second embodiment of the first concept.

As shown in FIG. 5, a strip dual mode loop resonator 51 comprises the input strip line 32, a rectangle-shaped strip line 52 in which the microwaves transferred from the input strip line 32 are resonated, the output strip line 34, the input coupling capacitor 35, and the output coupling capacitor 36.

Parts of four corners in the rectangle-shaped strip line 52 are cut off. Therefore, each of the four corners cut off functions as a parallel capacitor, a uniform line, or a series inductor, depending on the shape of the four corners cut off.

In the above configuration, the microwaves are resonated and filtered in the strip dual mode loop resonator 51 in the same manner as the strip dual mode loop resonator 31 shown in FIG. 3.

Accordingly, the resonance width of the microwaves resonated can be adjusted by changing the shape of the four corners.

Next, a third embodiment of the first concept according to the present invention is described.

Figure 6:
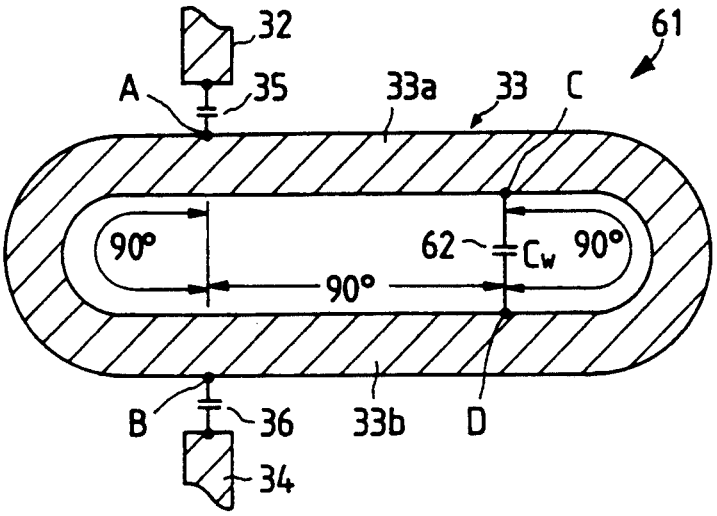
FIG. 6 is a plan view of a strip dual mode loop resonator according to a third embodiment of the first concept.

FIG. 6 is a plan view of a strip dual mode loop resonator according to a third embodiment of the first concept.

As shown in FIG. 6, a strip dual mode loop resonator 61 comprises the input strip line 32, the loop-shaped strip line 33 having the straight strip lines 33*a*, 33*b*, the output strip line 34, the input coupling capacitor 35, the output coupling capacitor 36, and a feed-back capacitor 62 for changing a characteristic impedance of the loop-shaped strip line 33.

The feed-back capacitor 62 has a lumped capacitance Cw. One end of the feed-back capacitor 62 is connected to the straight strip line 33a at a first connecting point C, and another end of the feed-back capacitor 62 is connected to the straight strip line 33*b* at a second connecting point D. The connecting point C is spaced 90 degrees (or a quarter-wave length of the microwaves) in the electric length apart from the input point A at which the input coupling capacitor 35 is connected to the straight strip line 33*a*. Also, the connecting point D is spaced 90 degrees in the electric length apart from the output point B at which the output coupling capacitor 36 is connected to the straight strip line 33*b*.

In the above configuration, microwaves having various wavelengths around the resonance wavelength $\lambda_o$ are transferred to the strip line 33 in the same manner as in the resonator 31 shown in FIG. 3.

Thereafter, to diffuse the electric field locally induced in the loop-shaped strip line 33, the microwaves transmit through the strip line 33 in the clockwise and counterclockwise directions in the strip line 33 having the uniform line impedance. In this case, because the straight strip lines 33*a*, 33*b* of the strip line 33 are coupled to each other in the electromagnetic coupling, a part of the microwaves are reflected in the straight, strip lines 33*a*, 33*b* to produce reflected waves. The reflected waves are circulated in loop-shaped the strip line 33 in the clockwise and counterclockwise directions.

Also, intensity of electric field in the loop-shaped strip line 33 is maximized at the connecting point D by the remaining part of microwaves not reflected in the straight strip lines 33*a*, 33*b* because the connecting point D is spaced 180 degrees (or a half-wave length of the microwaves) in the electric length apart from the input point A. Therefore, the intensity of the electric field at the connecting point C is maximized because the connecting points C, D are connected with each other through the feed-back capacitor 62. As a result, feed-back waves are generated at the connecting point C. The feed-back waves are circulated in the loop-shaped strip line 33 in the clockwise and counterclockwise directions. In cases where the wavelength of the microwaves agrees with the resonance wavelength $\lambda_o$, the microwaves formed of the reflected waves and the feed-back waves are resonated in the strip line 33 according to the characteristic impedance of the strip line 33. The characteristic impedance of the strip line 33 is determined according to the uniform line impedance of the strip line 33, the electromagnetic coupling between the straight strip lines 33*a*, 33*b* of the strip line 33, and the lumped capacitance Cw of the feed-back capacitor 62. In contrast, in cases where the wavelength of the microwaves does not agree with the resonance wavelength $\lambda_o$, the microwaves are disappeared in the strip line 33.

In this case, a resonance width (or a full width at half maximum) of the microwaves resonated in the strip line 33 is adjusted by changing the intensity of the electromagnetic coupling between the straight strip line 33*a*, 33*b* or the lumped capacitance Cw of the feed-back capacitor 62. The intensity of the electromagnetic coupling depends on the relative dielectric constant $\epsilon_r$ of the dielectric substrate 38, the relative width W/H, and the relative distance S/H.

Thereafter, intensity of the electric field in the loop shaped strip line 33 adjacent to the output strip line 34 is maximized by the reflected waves. Also, intensity of electric field in the loop-shaped strip line 33 adjacent to the output strip line 34 is maximized by the feed-back waves because the output point B is spaced 180 degrees in the electric length apart from the connecting point C.

Therefore, the microwaves in the strip line 33 are transferred to the output strip line 34 because the strip line 33 are coupled to the output strip line 34 in the capacitive coupling.

Accordingly, even though the relative width W/H and the relative distance S/H of the strip dual mode loop resonator 61 are fixed, the resonance width $\Delta\omega$ can be adjusted by changing the lumped capacitance Cw of the feed-back capacitor 62.

Next, frequency characteristics of the microwaves resonated in the strip dual mode loop resonator 61 is described.

Figure 7:
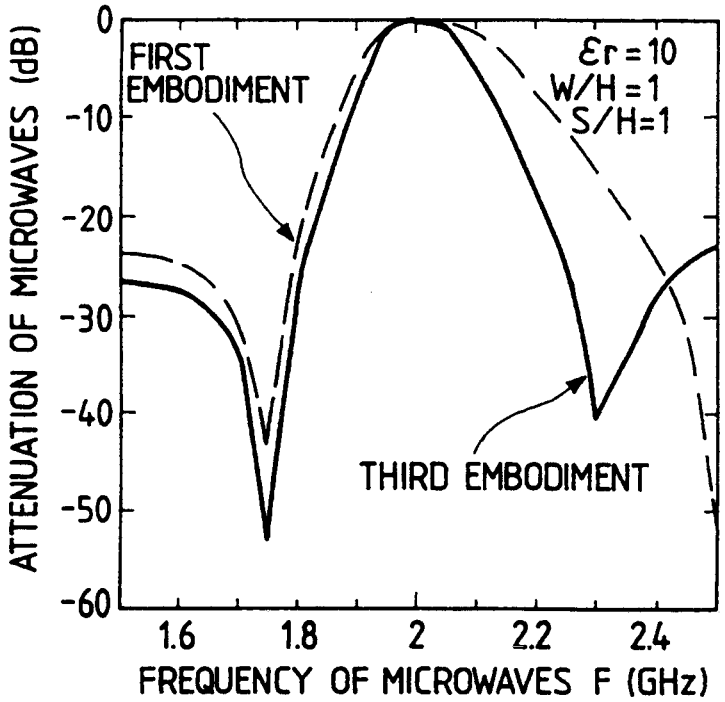
FIG. 7 shows frequency characteristics of the microwaves resonated in the strip dual mode loop resonator shown in FIG. 6.

FIG. 7 shows frequency characteristics of the microwaves resonated in the strip dual mode loop resonator 61 shown in FIG. 6.

As shown in FIG. 7, the intensity of the microwaves resonated in the strip dual mode loop resonator 61 is varied according to a frequency F(GHz) of the microwaves. That is, in cases where the relative dielectric constant $\epsilon_r=10$, the relative width W/H=1.0, and the relative distance S/H=1 are satisfied, a central frequency $\omega_o$ (or a resonance frequency relating to the resonance wavelength $\lambda_o$) of the microwaves is 2 GHz. Also, the resonance width $\Delta\omega$ of the microwaves in the strip dual mode loop resonator 61 is narrowed as compared with in the strip dual mode loop resonator 31 because the microwaves are transferred from the loop-shaped strip line 33 to the output strip line 34 by the action of the feed-back capacitor 62.

Also, the resonance width $\Delta\omega$ of the microwaves is narrowed in case of the relative distance S/H=3 (not shown) and in case of the relative distance S/H=5 (not shown) as compared with in the strip dual mode loop resonator 31.

Also, the resonance width $\Delta\omega$ of the microwaves is widened by changing the lumped capacitance Cw of the feed-back capacitor 62.

Accordingly, the resonance width $\Delta\omega$ of the microwaves can be suitably adjusted by adding the feed-back capacitor 62.

Next, a fourth embodiment of the first concept according to the present invention is described.

Figure 8:
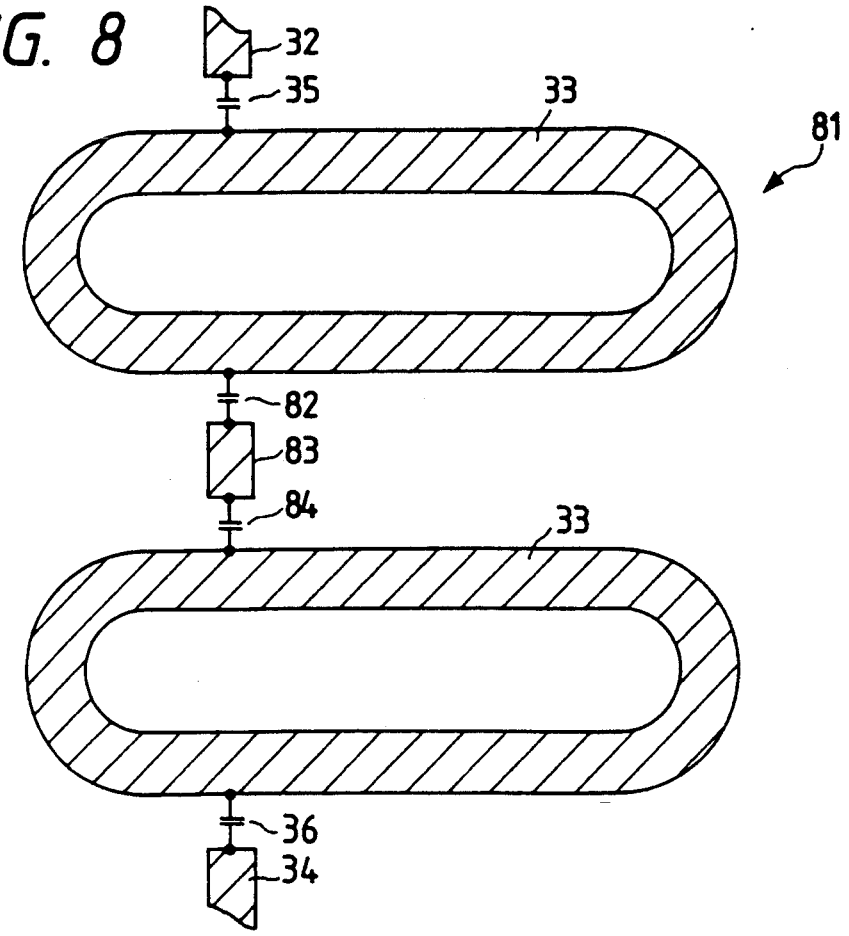
FIG. 8 is a plan view of a band-pass filter in which two strip dual mode loop resonators shown in FIG. 3 are arranged in series according to a fourth embodiment of the first concept.

FIG. 8 is a plan view of a band-pass filter in which two strip dual mode loop resonators 31 shown in FIG. 3 are arranged in series according to a fourth embodiment of the first concept.

As shown in FIG. 8, a band-pass filter 81 according to the fifth embodiment comprises the input strip line 32, the input coupling capacity 35, the loop-shaped strip line 33 arranged in a first-stage, an inter-stage coupling capacitor 82 to which microwaves are transferred from the first-stage loop-shaped strip line 33, an inter-stage strip line 83, an inter-stage coupling capacitor 84 to which the microwaves are transferred from the capacitor 82 through the strip line 83, the loop-shaped strip line 33 arranged in a second-stage, the output coupling capacitor 36, and the output strip line 34.

In the above configuration, each of the loop-shaped strip lines 33 functions as a resonator and filter in the dual modes, and the loop-shaped strip lines 33 are arranged in series. Therefore, the band-pass filter 81 functions as a four-stage filter.

Accordingly, because a central hollow portion of each of the resonators 33 is minimized, and because the central hollow portion is efficiently utilized to couple the straight strip lines 33*a*, 33*b*, an area occupied by the filter 81 can be minimized.

In the fourth embodiment, two resonators 31 according to the first embodiment are substantially arranged in series to manufacture the filter 81. However, the number of the resonators 31 is not limited to two. Also, it is preferred that a plurality of resonators 51 or 61 be arranged in series to manufacture a band-pass filter. Also, it is preferred that various types of resonators selected from the group consisting of the resonators 31, 51, and 61 be combined.

Also, it is preferred that the filter 81 comprise a multilayer type of resonators in which a plurality of resonators 31, 51, or 61 are arranged in a tri-plate structure.

In the first to fourth embodiment of the first concept, the strip lines (or balanced strip lines) are utilized to manufacture the resonators 31, 51, and 61 and the filter 81. However, it is preferred that microstrip lines generally utilized be utilized to manufacture the resonators 31, 51, and 61, and the filter 81.

Next, a first embodiment of a second concept according to the present invention is described.

Figure 9:
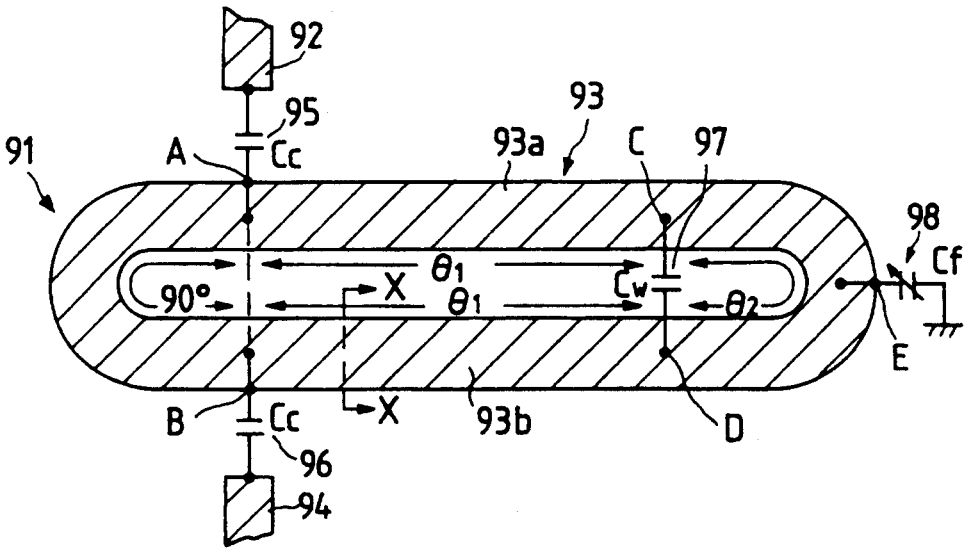
FIG. 9 is a plan view of a strip dual mode loop resonator according to a first embodiment of a second concept.
Figure 10B:
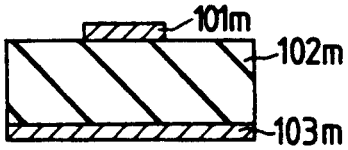
FIG. 10B is a sectional view taken generally along the line X—X of FIG. 9 according to a modification of the second concept.
Figure 10A:
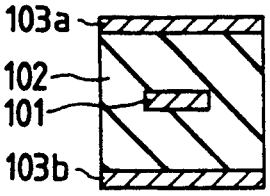
FIG. 10A is a sectional view taken generally along the line X—X of FIG. 9.

FIG. 9 is a plan view of a strip dual mode loop resonator according to a first embodiment of a second concept. FIG. 10A is a sectional view taken generally along the line X—X of FIG. 9.

As shown in FIG. 9, a strip dual mode loop resonator 91 comprises an input strip line 92 in which microwaves are transmitted, a loop-shaped strip line 98 having a uniform line impedance in which the microwaves transferred from the input strip line 92 are resonated, an output strip line 94 to which the microwaves resonated in the loop-shaped strip line 98 are transferred, an input coupling capacitor 95 for coupling the input strip line 92 to the loop-shaped strip line 98 in capacitive coupling to transfer the microwaves transmitted in the input strip line 92 to the loop-shaped strip line 93, an output coupling capacitor 96 for coupling the loop-shaped strip line 93 to the output strip line 94 in capacitive coupling to transfer the microwaves resonated in the loop-shaped strip line 93 to the output strip line 94, a line-to-line coupling capacitor 97 having a lumped capacitance Cw for changing a characteristic impedance of the loop-shaped strip line 93, and a variable capacitor 98 having a variable lumped capacitance Cf for changing the characteristic impedance of the loop-shaped strip line 93 in cooperation with the line-to-line coupling capacitor 97.

As shown in FIG. 10A, the loop-shaped strip line 93 comprises a strip conductive plate 101, a dielectric substrate 102 having a relative dielectric constant $\epsilon_r$ and surrounding the strip conductive plate 101, and a pair of conductive substrates 103*a*, 103*b* sandwiching the dielectric substrate 102. Therefore, when the microwaves transmit through the loop-shaped strip line 93, electromagnetic field is induced in the dielectric substrate 102 between the strip conductive plate 101 and the conductive substrates 103*a*, 103*b*. That is, the loop-shaped strip line 93 is formed of a balanced strip line.

Also, the input and output strip lines 92, 94 are composed of the strip conductive plate 101, the dielectric substrate 102, and the conductive substrates 103*a*, 103*b*, in the same manner as the loop-shaped strip line 93.

The second concept is not limited to the balanced strip line. That is, it is allowed that the input and output strip lines 92, 94 and the loop-shaped strip line 93 be respectively formed of a microstrip line shown in FIG. 10B. As shown in FIG. 10B, each of the strip lines 92, 93, and 94 comprises a strip conductive plate 101*m*, a dielectric substrate 102*m* mounting the strip conductive plate 101*m*, and a conductive substrate 103*m* mounting the dielectric substrate 102*m*.

An electric length of the loop-shaped strip line 93 depends on the relative dielectric constant $\epsilon_r$ of the dielectric substrate 102, and the electric length of the strip line 93 is equivalent to a resonance wavelength $\lambda_o$. Therefore, the length of the strip line 93 is 360 degrees in the electric length.

The loop-shaped strip line 93 has a pair of straight strip lines 93*a*, 93*b* arranged in parallel to each other. Therefore, the straight strip lines 93*a*, 93*b* are coupled to each other in electromagnetic coupling. In other words, first electromagnetic field induced by the microwaves transmitting through the straight strip line 93*a* and second electromagnetic field induced by the microwaves transmitting through the straight strip line 93*b* exert influence on each other, in the same manner as in the strip dual mode loop resonator 31 shown in FIG. 3.

The input and output coupling capacitors 95, 96 are respectively formed of a plate capacitor having a lumped capacitance Cc. One end of the input coupling capacitor 95 is connected to an input point A of the straight strip line 93*a*, and one end of the output coupling capacitor 96 is connected to an output point B of the straight strip line 93*b*. The output point B is spaced 90 degrees (or a quarter-wave length of the microwaves) in the electric length apart from the input point A, and the input and output points A, B are symmetrically arranged each ocher with respect to a middle line M positioned between the straight strip lines 93*a*, 93*b*.

The line-to-line coupling capacitor 97 is formed of a plate capacitor or a chip capacitor, and the variable capacitor 98 is formed of a plate capacitor. Both ends of the capacitor 97 are connected to the straight lines 93*a*, 93*b* at connecting points C, D which are spaced $\theta 1$ degrees apart from the input and output points A, B. The degree $\theta 1$ ranges up to 135 degrees (or a $\frac{3}{8}$-wave length of the microwaves) in the electric length. One end of the capacitor 98 is connected to the strip line 93 at a connecting point E which is positioned at equal intervals (or 135 degrees in the electric length) from the input and output points A, B, and another end of the capacitor 98 is grounded. The variable lumped capacitance Cf of the variable capacitor 98 can be minutely adjusted by cutting plates of the variable capacitor 98 after the strip dual mode loop resonator 91 is manufactured.

In the above configuration, when microwaves having various wavelengths around the resonance wavelength $\lambda_o$ are transmitted in the input strip line 92, electric field is strongly and locally induced in the straight strip line 93*a* adjacent to the input strip line 92 because lumped electric field is induced in the capacitor 95 by the microwaves. Therefore, the microwaves in the input strip line 92 are transferred to the strip line 93.

Thereafter, to diffuse the electric field locally induced in the loop-shaped strip line 93, the microwaves transmit through the strip line 93 in clockwise and counterclockwise directions in the strip line 93 having the uniform line impedance. In this case, because the straight strip lines 93*a*, 93*b* of the strip line 93 are coupled to each other in the electromagnetic coupling, a part of the microwaves are reflected in the straight strip lines 93*a*, 93*b* to produce reflected waves. The reflected waves are circulated in the strip line 93 in the clockwise and counterclockwise directions.

In cases where the wavelength of the microwaves agrees with the resonance wavelength $\lambda_o$, the microwaves ares resonated in the strip line 93 according to the characteristic impedance of the strip line 93. The characteristic impedance of the strip line 93 is determined according to the uniform line impedance of the strip line 93, the electromagnetic coupling between the straight strip lines 93*a*, 93*b*, the lumped capacitance Cw of the line-to-line capacitor 97, and the lumped capacitance Cf of the variable capacitor 98. In other words, a remaining part of the microwaves not reflected in the straight strip lines 93*a*, 93*b* are reflected by the the variable capacitor 98, or the phase of the remaining part of the microwaves are varied by the line-to-line capacitor 97. In contrast, in cases where the wavelength of the microwaves does not agree with the resonance wavelength $\lambda_o$, the microwaves are disappeared in the strip line 93.

In this case, a central frequency $\omega_o$ (or a resonance frequency relating to the resonance wavelength) of the microwaves resonated in the strip line 93 is adjusted by changing the lumped capacitance Cw of the line-to-line capacitor 97 and the lumped capacitance Cf of the variable capacitor 98. Also, a resonance width of the resonated microwaves is adjusted by changing either the lumped capacitance Cw of the line-to-line capacitor 97 or the lumped capacitance Cf of the variable capacitor 98.

Thereafter, intensity of the electric field in the loop-shaped strip line 93 adjacent to the output strip line 94 is maximized by the reflected waves. Therefore, the microwaves in the strip line 93 are transferred to the output strip line 94 because the strip line 93 are coupled to the output strip line 94 according to the capacitive coupling.

Accordingly, because the microwaves are resonated in the strip line 93 on condition that the wavelength of the microwaves agrees with the resonance wavelength $\lambda_o$, the strip dual mode loop resonator 91 functions as a resonator and filter.

Also, the microwaves transferred from the input strip line 92 are initially transmitted in the strip line 93 as non-reflected waves, and the microwaves are again transmitted in the strip line 93 as the reflected waves shifting by 90 degrees as compared with the non-reflected waves. In other words, two orthogonal modes formed of the non-reflected waves and the reflected waves independently coexist in the strip dual mode loop resonator 91. Therefore, the strip dual mode loop resonator 91 functions as a two-stage filter in the same manner as the conventional strip dual mode ring resonator 21.

Also, the central frequency of the resonated microwaves can be adjusted by changing the lumped capacitance Cw of the line-to-line capacitor 97 and the lumped capacitance Cf of the variable capacitor 98. Moreover, the central frequency of the resonated microwaves can be minutely adjusted by changing the lumped capacitance Cf of the variable capacitor 98 after the strip dual mode loop resonator 91 is manufactured.

Also, because the resonance width of the resonated microwaves can be adjusted by changing either the lumped capacitance Cw of the line-to-line capacitor 97 or the lumped capacitance Cf of the variable capacitor 98, the resonance width can be enlarged.

Also, even though the straight strip lines 93*a*, 93*b* are connected to each other through a lumped capacitor such as the line-to-line coupling capacitor 97 having the lumped capacitance Cw, the characteristic impedance of the strip line 93 can be changed.

Also, even though the input and output strip lines 92, 94 are coupled to the strip line 93 in the capacitive coupling through impedance elements such as the input and output coupling capacitors 95, 96 respectively having a lumped impedance, the microwaves can be transferred between the strip line 93 and the input and output strip lines 92, 94.

In addition, because the central frequency and the resonance width of the resonated microwaves can be adjusted after the resonator 91 is manufactured, a yield rate of the resonator 91 can be increased.

Next, a second embodiment of the second concept according to the present invention is described.

Figure 11:
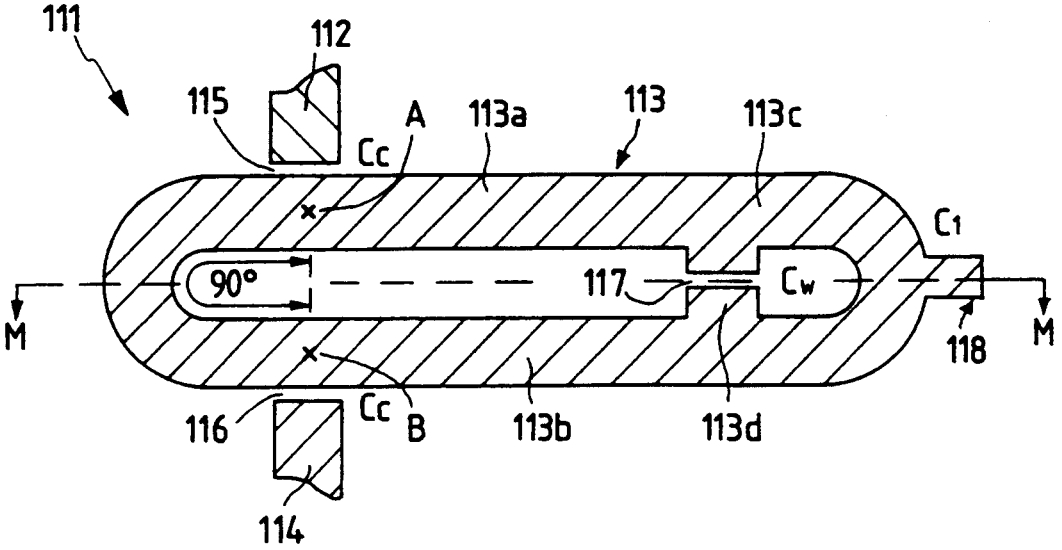
FIG. 11 is a plan view of a strip dual mode loop resonator according to a second embodiment of the second concept.

FIG. 11 is a plan view of a strip dual mode loop resonator according to a second embodiment of the second concept.

As shown in FIG. 11, a strip dual mode loop resonator 111 comprises an input strip line 112 in which microwaves are transmitted, a loop-shaped strip line 113 having a uniform line impedance in which the microwaves transferred from the input strip line 112 are resonated, an output strip line 114 in which the microwaves resonated in the loop-shaped strip line 113 are transmitted, an input gap capacitor 115 having a distributed capacitance Cc for coupling the input strip line 112 to the loop-shaped strip line 113 in capacitive coupling, an output gap capacitor 116 having the distributed capacitance Cc for coupling the loop-shaped strip line 113 to the output strip line 114 in capacitive coupling, a line-to-line gap capacitor 117 having a distributed capacitance Cw for changing a characteristic impedance of the loop-shaped strip line 113, and an open end stub 118 for changing the characteristic impedance of the loop-shaped strip line 113 in cooperation with the line-to-line gap capacitor 117.

The electric length of the loop-shaped strip line 113 agrees with a resonance wavelength $\lambda_o$, and the loop-shaped strip line 113 has a pair of straight strip lines 113*a*, 113*b* arranged in parallel to each other. Therefore, the straight strip lines 113*a*, 113*b* are coupled to each other in electromagnetic coupling in the same manner as the straight strip lines 93*a*, 93*b*. In addition, projecting portions 113*c*, 113*d* facing to each other inwardly extend from the straight strip lines 113*a*, 113*b* to form the line-to-line gap capacitor 117. Because the distance between the projecting portions 113*c*, 113*d* is narrower than that between the straight strip lines 113*a*, 113*b*, the projecting portions 113*c*, 113*d* are strongly coupled to each other according to the capacitive coupling.

The input gap capacitor 115 is formed by approaching the input strip line 112 to the straight strip line 113*a*.

The output gap capacitor 116 is formed by approaching the output strip line 114 to the straight strip line 113*b*.

A coupling portion A of the straight strip line 113*a* adjacent to the input strip line 113 is spaced 90 degrees in the electric length apart from a coupling portion B of the straight strip line 113*b* adjacent to the output strip line 114. The input and output strip lines 112, 114 are symmetrically arranged each other with respect to a middle line M positioned between the straight strip lines 113*a*, 113*b*.

The open end stub 118 is arranged at equal intervals (or 135 degrees in the electric length) from the coupling portions A, B of the straight strip lines 113*a*, 113*b*.

In the above configuration, microwaves having various wavelengths around the resonance wavelength $\lambda_o$ are transferred from the input strip line 112 to the loop-shaped strip line 113 because the input strip line 112 is coupled to the strip line 113 by the action of the gap capacitor 115. In the strip line 113, the microwaves are reflected in the straight strip lines 113*a*, 113*b*, the projecting portions 113*c*, 113*d*, and the open end stub 118 to produce reflected waves. Therefore, the characteristic impedance of the strip line 113 is determined according to the uniform line impedance of the strip line 113, the electromagnetic coupling between the straight strip lines 113*a*, 113*b*, the distributed gap capacitance Cw of the line-to-line gap capacitor 117, and a length of the open end stub 118 outwardly extending.

Thereafter, the reflected waves are circulated in the loop-shaped strip line 113. In cases where the wavelength of the microwaves agrees with the electric length of the strip line 113, the reflected waves are resonated in the strip line 113. In contrast, in cases where the wavelength of the microwaves does not agree with the electric length of the strip line 113, the reflected waves are disappeared in the strip line 113.

In this case, the intensity of the microwaves reflected in the open end stub 118 is varied by trimming the open end stub 118. Also, the intensity of the microwaves reflected in the line-to-line gap capacitor 117 depends on both a gap distance between the projecting portions 113*c*, 113*d* and a gap width of the projecting portions 113*c*, 113*d*.

Thereafter, intensity of electric field in the strip line 113 adjacent to the output strip line 114 is maximized by the microwaves resonated in the strip line 113. Therefore, the microwaves resonated are transferred to the output strip line 114.

Accordingly, even though the straight strip lines 113*a*, 113*b* are connected to each other through a distributed impedance element such as the line-to-line gap capacitor 117 having a distributed constant, the characteristic impedance of the strip line 113 can be changed.

Also, because the input and output strip lines 112, 114 are coupled to the strip line 113 in the capacitive coupling, the microwaves can be transferred between the strip line 113 and the input and output strip lines 112, 114.

Also, the resonance width of the resonated microwaves can be adjusted by trimming the open end stub 118.

Also, not only the resonance width of the resonated microwaves but also the central frequency of the resonated microwaves can be adjusted by trimming the open end stub 118 and the projecting portions 113*c*, 113*d*.

Next, a third embodiment of the second concept according to the present invention is described.

Figure 12:
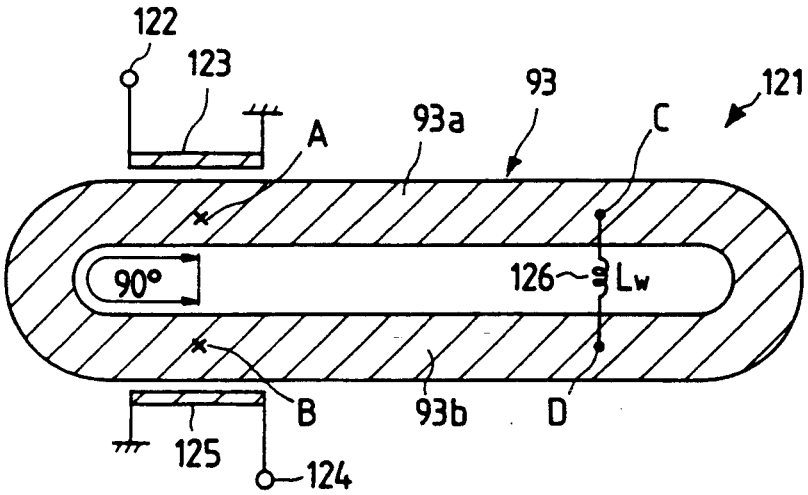
FIG. 12 is a plan view of a strip dual mode loop resonator according to a third embodiment of the second concept.

FIG. 12 is a plan view of a strip dual mode loop resonator according to a third embodiment of the second concept.

As shown in FIG. 12, a strip dual mode loop resonator 121 comprises an input strip line 122 in which microwaves are transmitted, the loop-shaped strip line 93 in which the microwaves transferred from the input strip line 122 is resonated, an input magnetic coupling line 123 arranged in parallel to the strip line 93 for coupling the input strip line 122 to the strip line 93 in magnetic coupling (or inductive coupling) by inducing magnetic field therein, an output strip line 124 to which the microwaves resonated in the loop-shaped strip line 93 are transferred, an output magnetic coupling line 125 arranged in parallel to the strip line 93 for coupling the output strip line 124 to the strip line 93 in magnetic coupling (or inductive coupling) by inducing magnetic field therein, and a line-to-line coupling inductor 126 having a lumped inductance Lw for changing a characteristic impedance of the loop-shaped strip line 93.

A coupling portion A of the straight strip line 93*a* adjacent to the input magnetic coupling line 123 is spaced 90 degrees in the electric length apart from a coupling portion B of the straight strip line 93*b* adjacent to the output magnetic coupling line 124.

One end of the input magnetic coupling line 123 is connected to the input strip line 122, and another end of the input magnetic coupling line 123 is grounded. A line width of the input magnetic coupling line 123 is narrow so that magnetic field is dominantly induced around the input magnetic coupling line 123 when the microwaves are transmitted therein. Therefore, the input strip line 122 is coupled to the loop-shaped strip line 93 in the magnetic coupling.

Also, one end of the output magnetic coupling line 125 is connected to the output strip line 124, and another end of the output magnetic coupling line 125 is grounded. A line width of the output magnetic coupling line 123 is narrow so that magnetic field is dominantly induced around the output magnetic coupling line 123 when magnetic field induced by the microwaves is increased at the coupling portion B. Therefore, the output strip line 124 is coupled to the loop-shaped strip line 93 in the magnetic coupling.

Both ends of the line-to-line coupling inductor 126 are connected to the straight strip lines 93*a*, 93*b* at connecting points C, D. The connecting point C is spaced $\theta 1$ degrees in the electric length apart from the coupling portion A. In the same manner, the connecting point D is spaced $\theta 1$ degrees in the electric length apart from the coupling portion B.

In the above configuration, when microwaves having various wavelengths around the resonance wavelength $\lambda_o$ is transmitted in the input strip line 122, the input magnetic coupling line 123 is coupled to the loop-shaped strip line 93 in the magnetic coupling. That is, magnetic field is locally induced in the loop-shaped strip line 93 adjacent to the input magnetic coupling line 123. Therefore, the microwaves are transferred to the loop-shaped strip line 93. Thereafter, to diffuse the magnetic field locally induced in the strip line 93, the microwaves are transmitted in the strip line 93 according to the characteristic impedance of the strip line 93. The characteristic impedance is determined according to the uniform line impedance of the strip line 93, the electromagnetic coupling of the straight strip lines 93*a*, 93*b* and the line-to-line coupling inductor 126. Therefore, the microwaves are reflected at the straight strip lines 93*a*, 93*b* and the line-to-line coupling inductor 126 to produce reflected waves.

Thereafter, the reflected waves are circulated in the strip line 93 in the clockwise and counterclockwise directions. In this case, when the wavelength of the microwaves agrees with the resonance wavelength $\lambda_o$, the microwaves are resonated in the strip line 93. Also, intensity of magnetic field in the strip line 93 adjacent to the output magnetic coupling line 125 is maximized by the reflected waves on condition that the wavelength of the microwaves agrees with the resonance wavelength $\lambda_o$. Therefore, the strip line 93 adjacent to the output magnetic coupling line 125 is coupled to the output strip line 124 in the magnetic coupling by the action of the output magnetic coupling line 125. This is, the microwaves in the strip line 93 are transferred to the output strip line 125.

Accordingly, the strip dual mode loop resonator 121 functions as a filter and resonator because the microwaves are resonated in the strip line 93 in cases where the wavelength of the microwaves agrees with the resonance wavelength $\lambda_o$.

Also, because two orthogonal modes formed of the non-reflected waves and the reflected waves shifting by 90 degrees as compared with the non-reflected waves independently coexist in the strip dual mode loop resonator 93, the strip dual mode loop resonator 121 functions as a two-stage filter in the same manner as the strip dual mode loop resonator 91.

Also, even though the input and output strip lines are coupled to the strip line 113 in the magnetic coupling, the microwaves can be transferred between the strip line 93 and the input and output strip lines 122, 124.

Also, even though the straight strip lines 93*a*, 93*b* are connected to each other through a lumped inductor such as the line-to-line coupling inductor 126 having the lumped inductance Lw, the characteristic impedance of the strip line 93 can be changed.

Also, even though the characteristic impedance is adjusted by changing the lumped inductance Lw of the line-to-line coupling inductor 126, the resonance width of the resonated microwaves can be adjusted.

Next, a fourth embodiment of the second concept according to the present invention is described.

Figure 13:
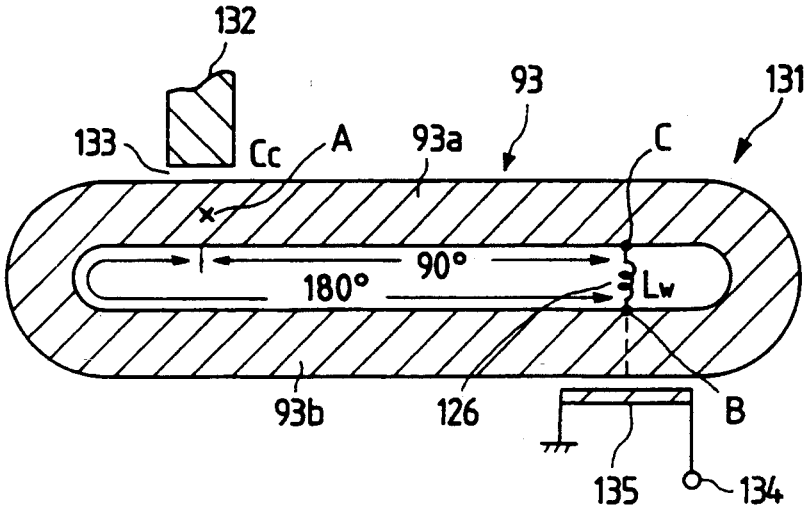
FIG. 13 is a plan view of a strip dual mode loop resonator according to a fourth embodiment of the second concept.

FIG. 13 is a plan view of a strip dual mode loop resonator according to a fourth embodiment of the second concept.

As shown in FIG. 13, a strip dual mode loop resonator 131 comprises an input coupling line 132 in which microwaves are transmitted, the loop-shaped strip line 93 in which the microwaves transferred from the input coupling line 132 are resonated, a gap capacitor 133 having a distributed capacitance Cc for coupling the input coupling line 132 and the strip line 93 in capacitive coupling, the line-to-line coupling inductor 126, an output coupling line 134 to which the microwaves resonated in the loop-shaped strip line 93 are transferred, and a magnetic coupling line 135 arranged in parallel to the strip line 93 for coupling the output coupling line 134 to the strip line 93 in magnetic coupling.

The gap capacitor 133 is formed by approaching the input coupling line 132 to the loop-shaped strip line 93.

A coupling portion A of the straight strip line 93*a* adjacent to the input coupling line 132 is spaced 180 degrees (a half-wave length of the microwaves) in the electric length apart from a coupling portion B of the straight strip line 113*b* adjacent to the output magnetic coupling line 135.

One end of the line-to-line coupling inductor 126 is connected to the straight strip lines 93*a* at a connecting point C, and another end of the line-to-line coupling inductor 126 is connected to the straight strip lines 93*b* at the coupling portion B. The connecting point C is spaced 90 degrees in the electric length apart from the coupling portion A.

In the above configuration, when microwaves having various wavelengths around the resonance wavelength $\lambda_o$ transmit through the input coupling line 132, intensity of electric field is maximized at the strip line 93 adjacent to the input coupling line 132 by the action of the gap capacitor 133. Therefore, the microwaves are transferred to the strip line 93. Thereafter, to diffuse the electric field, the microwaves are transmitted in the clockwise and counterclockwise directions. In this case, because the characteristic impedance of the strip line 93 is determined according to the uniform line impedance of the strip line 93, the electromagnetic coupling of the straight strip lines 93*a*, 93*b*, and the line-to-line coupling inductor 126. Therefore, the travelling waves are reflected at the straight strip lines 93*a*, 93*b* and the line-to-line coupling inductor 126 to produce reflected waves. The reflected waves are circulated in the strip line 93 in the clockwise and counterclockwise directions.

In cases where the wavelength of the microwaves agrees with the resonance wavelength $\lambda_o$, the microwaves formed of the reflected waves are resonated in the strip line 93, and the intensity of the magnetic field induced by the reflected waves is maximized at the coupling portion B. Therefore, the output coupling line 134 is coupled to the strip line 93 in the magnetic coupling by the action of the magnetic coupling line 135 so that the microwaves resonated in the strip line 93 are transferred to the output coupling line 134.

Accordingly, the strip dual mode loop resonator 131 functions as a filter and resonator because the microwaves are resonated in the strip line 93 in cases where the wavelength of the microwaves agrees with the resonance wavelength $\lambda_o$.

Also, because two orthogonal modes formed of the non-reflected waves and the reflected waves shifting by 90 degrees as compared with the non-reflected waves independently coexist in the strip dual mode loop resonator 93, the strip dual mode loop resonator 131 functions as a two-stage filter in the same manner as the strip dual mode loop resonator 91.

Also, even though the input and output coupling lines 132, 134 are coupled to the strip line 93 in different types of impedance coupling such as the capacitive coupling and the magnetic coupling, the microwaves can be transferred between the strip line 131 and the input and output coupling lines 132, 134.

Next, a fifth embodiment of the second concept according to the present invention is described.

Figure 14:
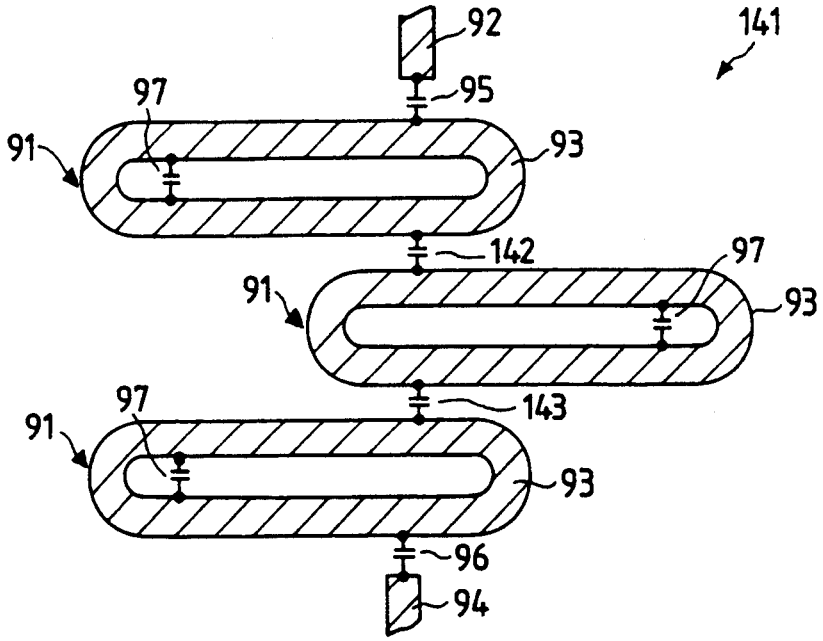
FIG. 14 is a plan view of a band-pass filter in which three strip dual mode loop resonators shown in FIG. 9 are arranged in series according to a fifth embodiment of the second concept.

FIG. 14 is a plan view of a band-pass filter in which three strip dual mode loop resonators 91 shown in FIG. 9 are arranged in series according to a fifth embodiment of the second concept.

As shown in FIG. 14, a band-pass filter 141 according to the fifth embodiment comprises a series of three strip dual mode loop resonators 91. That is, the strip dual mode loop resonator 91 in a first stage is connected with the strip dual mode loop resonator 91 in a second stage through an inter-stage coupling capacitor 142. Also, the strip dual mode loop resonator 91 in the second stage is connected with the strip dual mode loop resonator 91 in a third stage through an inter-stage coupling capacitor 143.

In the above configuration, each of the strip lines 93 in the strip dual mode loop resonators 91 functions as a resonator and filter in dual modes. Therefore, the band-pass filter 141 functions as a six-stage filter.

Accordingly, because central hollow portions of the resonators 91 are minimized, and because the central hollow portions are efficiently utilized to couple the straight strip lines 93*a*, 93*b*, an area occupied by the filter 141 can be minimized.

In the fifth embodiment, three resonators 91 according to the first embodiment is utilized to manufacture the filter 41. However, the number of the resonators 91 is not limited to three. Also, it is preferred that a plurality of resonators 111, 121, or 131 be arranged in series to manufacture a band-pass filter. Also, it is preferred that various types of resonators selected from the resonators 91, 111, 121, and 131 be combined.

Also, it is preferred that the filter 141 comprise a multilayer type of resonators in which a plurality of resonators 91, 111, 121, or 131 are arranged in a tri-plate structure.

In the first and fifth embodiment, the strip lines (or balanced strip lines) are utilized to manufacture the resonators 91, 111, 121, and 131 and the filter 141. However, it is preferred that microstrip lines be utilized to manufacture the resonators 91, 111, 121, and 131 and the filter 141.

Next, a first embodiment of a third concept according to the present invention is described.

Figure 15:
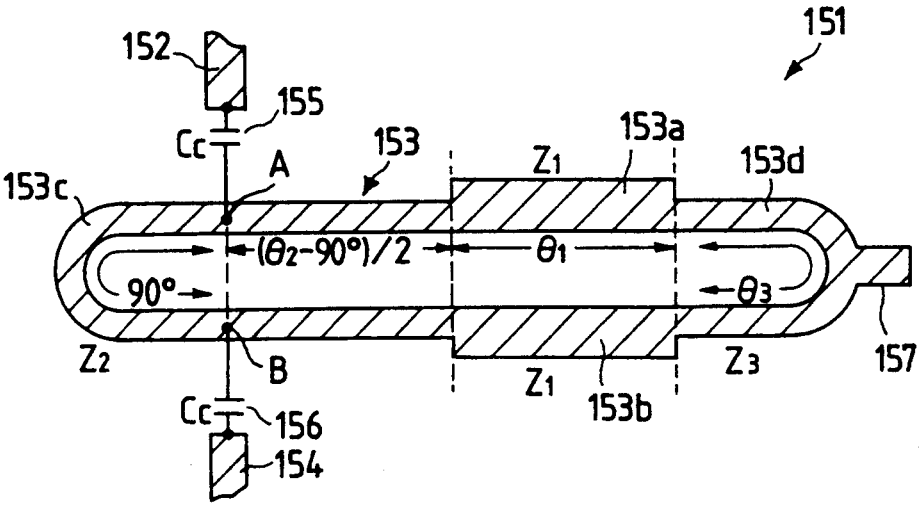
FIG. 15 is a plan view of a strip dual mode loop resonator according to a first embodiment of the third concept.

FIG. 15 is a plan view of a strip dual mode loop resonator according to a first embodiment of the third concept.

As shown in FIG. 15, a strip dual mode loop resonator 151 comprises an input strip line 152 in which microwaves are transmitted, a loop-shaped strip line 153 in which the microwaves transferred from the input strip line 152 are resonated, an output strip line 154 in which the microwaves resonated in the loop-shaped strip line 153 are transmitted, an input coupling capacitor 155 having a lumped capacitance Cc for coupling the input strip line 152 to the loop-shaped strip line 153 in capacitive coupling, an output coupling capacitor 156 having the lumped capacitance Cc for coupling the loop-shaped strip line 153 to the output strip line 154 in capacitive coupling, and an open end stub 157 for changing the characteristic impedance of the loop-shaped strip line 153.

An electric length of the loop-shaped strip line 153 agrees with a resonance wavelength $\lambda_o$, and the loop-shaped strip line 153 is divided into three blocks.

A pair of widened strip lines 153*a*, 153*b* are provided in a first block of the loop-shaped strip line 153. The widened strip lines 153*a*, 153*b* are arranged in parallel to each other. The widened strip lines 153*a*, 153*b* respectively have an electric length $\theta 1$ ($\theta 1 < 90°$), a widened width W1, and a line impedance Z1.

A second block of the loop-shaped strip line 153 is positioned at a first side (or a left side in FIG. 15) of the first block, and a U-shaped narrow strip line 153*c* having an electric length $\theta 2$ ($\theta 2 > 90°$) is provided in the second block. One end of the U-shaped narrow strip line 153*c* is connected to a first side end of the widened strip line 153*a*, and the other end of the U-shaped narrow strip line 153*c* is connected to a first side end of the widened strip line 153*b*. A width of the narrow strip line 153*c* is W2 narrower than the widths W1 of the widened strip lines 153*a*, 153*b*, and a line impedance of the narrow strip line 153*c* is Z2. Because both straight portions of the U-shaped narrow strip line 153*c* are approached each other, the straight portions of the U-shaped narrow strip line 153*c* are coupled to each other in the electromagnetic coupling.

A third block of the loop-shaped strip line 153 is positioned at a second side (or a right side in FIG. 15) of the first block, and a U-shaped narrow strip line 153*d* is provided in the third block. One end of the narrow strip line 153*d* is connected to a second end of the widened strip line 153*a*, and the other end of the narrow strip line 153*d* is connected to a second end of the widened strip line 153*b*. The narrow strip line 153*d* has an electric length $\theta 3$, the width W2, and a line impedance Z3.

In this case, a relational equation $2*\theta 1+\theta 2+\theta 3=360$ degrees is satisfied. Also, the line impedance Z1 differs from the line impedance Z2 and the line impedance Z3 to produce four line impedance difference points at boundaries of the blocks in the loop-shaped strip line 153.

Also, a flat surface is formed of an inside surface of the widened strip line 153*a*, an inside surface of the narrow strip line 153*c*, and an inside surface of the narrow strip line 153*d*. Also, another flat surface is formed of an inside surface of the widened strip line 153*b*, another inside surface of the narrow strip line 153*c*, and another inside surface of the narrow strip line 153*d*. That is, the widened strip lines 153*a*, 153*b* are manufactured by outwardly widening strip lines as compared with the narrow strip line 153*c*.

Therefore, electromagnetic coupling between the widened strip lines 153*a*, 153*b*, electromagnetic coupling between both ends of the narrow strip line 153*c*, and electromagnetic coupling between both ends of the narrow strip line 153*d* are the same.

The input and output strip lines 152, 154 are respectively formed of a plate capacitor, and are coupled to the narrow strip line 153*c* through the input and output coupling capacitors 155, 156. One end of the input coupling capacitor 155 is connected to an input point A of the narrow strip line 153*c*, and one end of the output coupling capacitor 156 is connected to an output point B of the narrow strip line 153*c*. The input and output points A, B are symmetrically positioned with respect to the narrow strip line 153*c*, and the output point B is spaced 90 degrees (or a quarter-wave length of the microwaves) in the electric length apart from the input point A.

The open end stub 157 is connected to the middle of the narrow strip line 153*d*, and the open end stub 157 is arranged at equal intervals (or 135 degrees in the electric length) from the input and output points A, B.

In the above configuration, microwaves having various wavelengths around the resonance wavelength $\lambda_o$ is transferred from the input strip line 152 to the loop-shaped strip line 153 because the input strip line 152 is coupled to the strip line 153 by the action of the input coupling capacitor 155. In the strip line 153, the line impedance of the strip line 153 is changed by the line impedance difference points in the strip line 153. Therefore, the microwaves are reflected in each of the blocks to produce reflected waves. Also, the microwaves are reflected in the open end stub 158. This is, the characteristic impedance of the strip line 153 is determined according to the electromagnetic coupling between the widened lines 153*a*, 153*b*, the line impedances Z1, Z2, and Z3 of the blocks, the electric lengths $\theta 1$, $\theta 2$, and $\theta 3$, and the open end stub 157. Thereafter, the reflected waves are circulated in the strip line 153 in clockwise and counterclockwise directions.

Thereafter, in cases where the wavelength of the microwaves agrees with the electric length of the strip line 153, the microwaves are resonated in the strip line 153. In this case, the intensity of the microwaves reflected in the open end stub 157 is varied by trimming the open end stub 158. Thereafter, the intensity of the electric field at the output point B is maximized by the microwaves resonated in the strip line 153. Therefore, the microwaves resonated are transferred to the output strip line 154 by the action of the output coupling capacitor 156.

Accordingly, because the microwaves are resonated in the strip line 153 on condition that the wavelength of the microwaves agrees with the resonance wavelength $\lambda_o$, the strip dual mode loop resonator 151 functions as a resonator and filter.

Also, the microwaves transferred from the input strip line 152 are initially transmitted in the strip line 153 as non-reflected waves, and the microwaves are again transmitted in the strip line 153 as the reflected waves shifting by 90 degrees as compared with the non-reflected waves. In other words, two orthogonal modes formed of the non-reflected waves and the reflected waves independently coexist in the strip dual mode loop resonator 151. Therefore, the strip dual mode loop resonator 151 functions as a two-stage filter in the same manner as the conventional strip dual mode ring resonator 21.

Also, because the characteristic impedance of the strip line 153 is determined according to the electromagnetic coupling between the widened lines 153*a*, 153*b*, the line impedances Z1, Z2, and Z3 of the blocks, the electric lengths $\theta 1$, $\theta 2$, and $\theta 3$, and the open end stub 157, the characteristic impedance can be suitably adjusted in a wide range. Therefore, a resonance width of the resonated microwaves can be suitably adjusted by changing the characteristic impedance. That is, the strip dual mode loop resonator 151 having a widened resonance width can be manufactured.

Also, a central frequency of the resonated microwaves can be adjusted by changing the characteristic impedance. Specifically, the central frequency of the resonated microwaves can be minutely adjusted by trimming the open end stub 157 after the strip dual mode loop resonator 151 is manufactured.

Also, because the central frequency of the resonated microwaves can be adjusted after the strip dual mode loop resonator 151 is manufactured, a yield rate of the resonator 151 can be increased.

Also, because the characteristic impedance can be suitably adjusted in a wide range, the resonator 151 having a superior performance can be stably manufactured.

Next, a second embodiment of the third concept according to the present invention is described.

Figure 16:
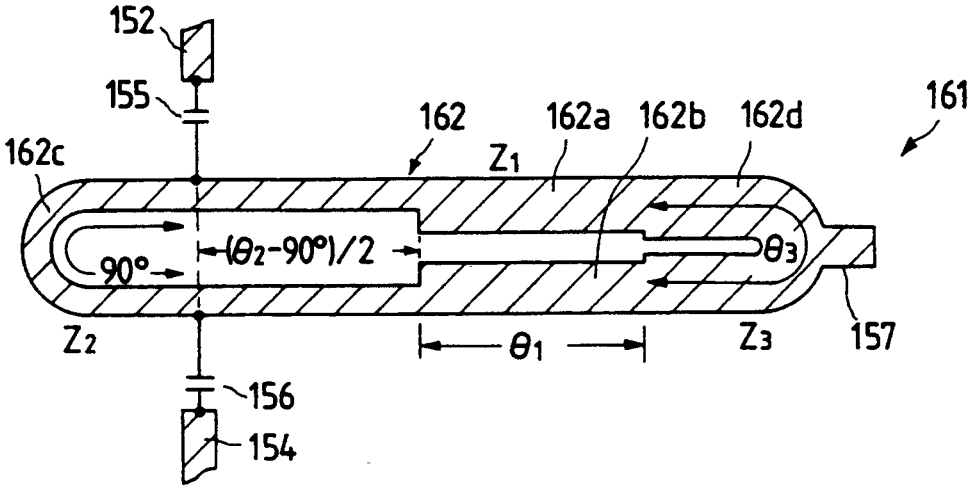
FIG. 16 is a plan view of a strip dual mode loop resonator according to a second embodiment of the third concept.

FIG. 16 is a plan view of a strip dual mode loop resonator according to a second embodiment of the third concept.

As shown in FIG. 16, a strip dual mode loop resonator 161 comprises the input strip line 152, a loop-shaped strip line 162 in which the microwaves transferred from the input strip line 152 are resonated, the output strip line 154, the input coupling capacitor 155, the output coupling capacitor 156, and the open end stub 157.

An electric length of the loop-shaped strip line 162 agrees with a resonance wavelength $\lambda_o$, and the loop-shaped strip line 162 is divided into three blocks.

A pair of straight strip lines 162*a*, 162*b* are provided in a first block of the loop-shaped strip line 162. The straight strip lines 162*a*, 162*b* are arranged in parallel to each other. The straight strip lines 162*a*, 162*b* respectively have an electric length $\theta 1$ ($\theta 1 < 90°$), a width W1, and a line impedance Z1.

A second block of the loop-shaped strip line 162 is positioned at a first side (or a left side in FIG. 16) of the first block, and a U-shaped narrow strip line 162*c* having an electric length $\theta 2$ ($\theta 2 > 90°$) is provided in the second block. One end of the U-shaped narrow strip line 162*c* is connected to a first side end of the straight strip line 162*a*, and the other end of the U-shaped narrow strip line 162*c* is connected to a first side end of the straight strip line 162*b*. A width of the narrow strip line 162*c* is W2 narrower than the widths W1 of the straight strip lines 162*a*, 162*b*, and a line impedance of the narrow strip line 162*c* is Z2. Because both straight portions of the U-shaped narrow strip line 162*c* are approached each other, the straight portions of the U-shaped narrow strip line 162*c* are coupled to each other in the electromagnetic coupling.

A third block of the loop-shaped strip line 162 is positioned at a second side (or a right side in FIG. 16) of the first block, and a U-shaped widened strip line 162*d* is provided in the third block. One end of the widened strip line 162*d* is connected to a second end of the straight strip line 162*a*, and the other end of the widened strip line 162*d* is connected to a second end of the straight strip line 162*b*. The widened strip line 162*d* has an electric length $\theta 3$, a width W3 wider than W2, and a line impedance Z3.

In this case, a relational equation $2*\theta 1+\theta 2+\theta 3=360$ degrees is satisfied. Also, the line impedances Z1, Z2, and Z3 differ from each other. Therefore, there are four line impedance difference points at boundaries of the blocks in the loop-shaped strip line 162.

Also, a flat surface is formed of an outside surface of the straight strip line 162*a*, an outside surface of the narrow strip line 162*c*, and an outside surface of the widened strip line 162*d*. Also, another flat surface is formed of an outside surface of the straight strip line 162*b*, an outside surface of the narrow strip line 162*c*, and an outside surface of the widened strip line 162*d*.

That is, the straight and widened strip lines 162*a*, 162*b*, 162*d* are manufactured by inwardly widening strip lines as compared with the narrow strip line 162*c*.

Therefore, a distance between the straight strip lines 162*a*, 162*b* is narrower than that between both ends of the narrow strip line 162*c*. Also, a distance between both ends of the widened strip line 162*d* is narrower than that between the straight strip lines 162*a*, 162*b*. As a result, electromagnetic coupling between the straight strip lines 162*a*, 162*b* is stronger than that between both ends of the narrow strip line 162*c*. Also, electromagnetic coupling between both ends of the widened strip line 162*d* is stronger than that between the straight strip lines 162*a*, 162*b*.

The input and output strip lines 152, 154 are coupled to the narrow strip line 162*c* through the input and output coupling capacitors 155, 156. One end of the input coupling capacitor 155 is connected to an input point A of the narrow strip line 162*c*, and one end of the output coupling capacitor 156 is connected to an output point B of the narrow strip line 162*c*. The input and output points A, B are symmetrically positioned with respect to the narrow strip line 162*c*, and the output point B is spaced 90 degrees (or a quarter-wave length of the microwaves) in the electric length apart from the input point A.

The open end stub 157 is connected to the middle of the widened strip line 162*d*, and the open end stub 157 is arranged at equal intervals (or 135 degrees in the electric length) from the input and output points A, B.

In the above configuration, microwaves having various wavelengths around the resonance wavelength $\lambda_o$ are transferred from the input strip line 152 to the strip line 162 because the input strip line 152 is coupled to the strip line 162 by the action of the input coupling capacitor 155. In the strip line 162, the line impedance of the strip line 162 is changed by the line impedance difference points. Therefore, the microwaves are reflected in each of the blocks to produce reflected waves. Also, the microwaves are reflected in the open end stub 157. This is, the characteristic impedance of the strip line 162 is determined according to the electromagnetic coupling between both ends of the narrow strip line 162*c*, the electromagnetic coupling between the straight strip lines 162*a*, 162*b*, the electromagnetic coupling between both ends of the widened strip line 162*d*, the line impedances Z1, Z2, and Z3 of the blocks, the electric lengths $\theta 1$, $\theta 2$, and $\theta 3$, and the open end stub 157. Thereafter, the reflected waves are circulated in the strip line 162 in clockwise and counterclockwise directions.

Thereafter, in cases where the wavelength of the microwaves agrees with the electric length of the strip line 162, the reflected waves are resonated in the strip line 162. In this case, the intensity of the microwaves reflected in the open end stub 157 is varied by trimming the open end stub 168. Thereafter, intensity of electric field at the output point B is maximized by the microwaves resonated in the strip line 162. Therefore, the microwaves resonated are transferred to the output strip line 154 by the action of the output coupling capacitor 156.

Accordingly, because the straight strip lines 162*a*, 162*b* and the widened strip line 162*d* are inwardly widened each other, an occupied area required to manufacture the strip dual mode loop resonator 161 can be minimized as compared with the resonator 151 shown in FIG. 15.

Also, the strip dual mode loop resonator 161 functions as a dual mode resonator and filter in the same manner as the resonator 151 shown in FIG. 15.

Also, a resonance width and a central frequency can be adjusted in the same manner as the resonator 151 shown in FIG. 15.

Also, because the central frequency of the resonated microwaves is adjusted by changing the characteristic impedance of the strip line 162 and the length of the open end stub 157, a yield rate of the resonator 161 can be increased in the same manner as the resonator 151 shown in FIG. 15.

In the second embodiment of the third concept, all of the narrow and widened strip lines 162*a*, 162*b*, 162*c*, 162*d* are coupled to each other in the electromagnetic coupling. However, it is not necessary to couple all of the narrow and widened strip lines 162*a*, 162*b*, 162*c*, 162*d* to each other.

In the first and second embodiments, the open end stub 157 is attached to the narrow strip line 153*d* and the widened strip line 162*d*. However, it is preferred that the variable capacitor 38 shown in FIG. 3 be attached to the narrow strip line 153*d* and the widened strip line 162*d*.

Also, the input and output coupling capacitors 155, 156 are arranged to couple the input and output strip lines 152, 154 to the narrow strip lines 153*c*, 162*c*. However, it is preferred that the input and output gap capacitors 52, 54 shown in FIG. 5 be arranged to couple the input and output strip lines 152, 154 to the narrow strip lines 153*c*, 162*c*.

Next, a third embodiment of the third concept according to the present invention is described.

Figure 17:
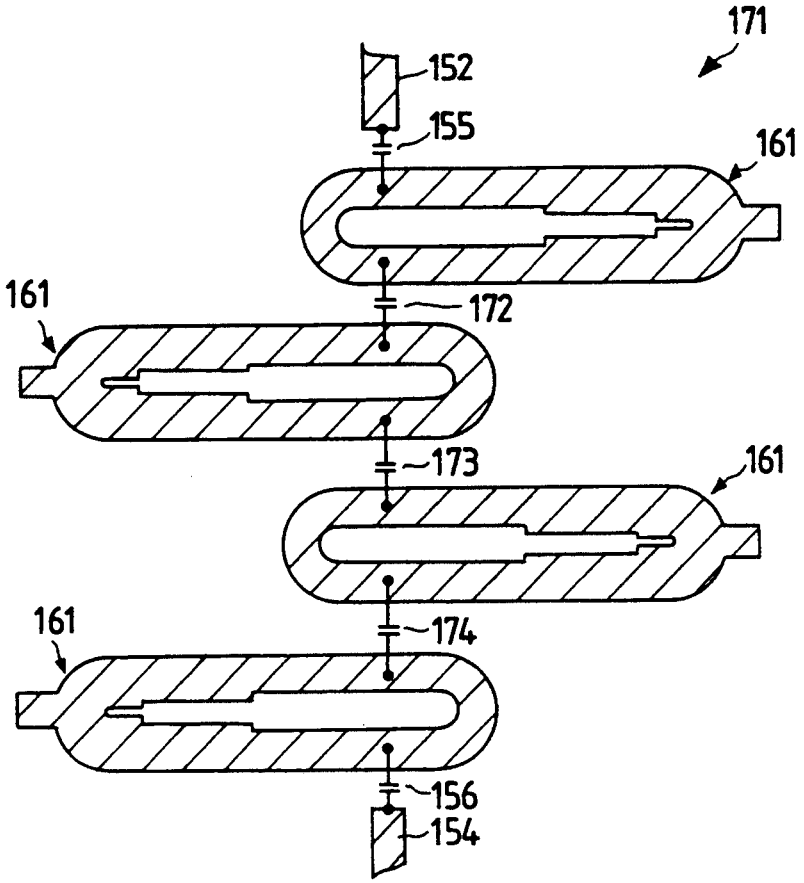
FIG. 17 is a plan view of a band-pass filter in which four strip dual mode loop resonators shown in FIG. 16 are arranged in series according to a third embodiment of the third concept.

FIG. 17 is a plan view of a band-pass filter in which four strip dual mode loop resonators 161 shown in FIG. 16 are arranged in series according to a third embodiment of the third concept.

As shown in FIG. 17, a band-pass filter 171 according to the third embodiment comprises a series of fourth strip dual mode loop resonators 161. That is, the strip dual mode loop resonator 161 in a first stage is connected with the strip dual mode loop resonator 161 in a second stage through an inter-stage coupling capacitor 172, the strip dual mode loop resonator 161 in the second stage is connected with the strip dual mode loop resonator 161 in a third stage through an inter-stage coupling capacitor 173, and the strip dual mode loop resonator 161 in the third stage is connected with the strip dual mode loop resonator 161 in a fourth stage through an inter-stage coupling capacitor 174.

In the above configuration, each of the strip lines 162 in the strip dual mode loop resonators 161 functions as a dual mode resonator and filter. Therefore, the band-pass filter 171 functions as an eight-stage filter.

Accordingly, because central hollow portions of the resonators 161 are minimized, and because the central hollow portions are efficiently utilized to couple the strip lines 162*a* to 162*d*, an area occupied by the filter 171 can be minimized.

In the third embodiment of the third concept, three resonators 161 according to the second embodiment is utilized to manufacture the filter 171. However, the number of the resonators 161 is not limited to four. Also, it is preferred that a plurality of resonators 151 shown in FIG. 15 be arranged in series to manufacture a band-pass filter. Also, it is preferred that the resonators 151, 161 be combined.

Also, it is preferred that the filter 171 comprise a multilayer type of resonators in which a plurality of resonators 151 or 161 are arranged in a tri-plate structure.

In the first and third embodiment of the third concept, the strip lines (or balanced strip lines) are utilized to manufacture the resonators 151, 161 and the filter 171. However, it is preferred that microstrip lines be utilized to manufacture the resonators 151, 161 and the filter 171.

Next, a first embodiment of a fourth concept according to the present invention is described.

Figure 18:
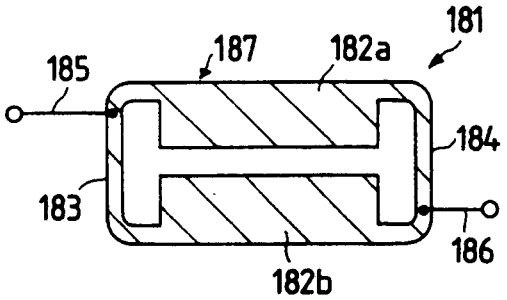
FIG. 18 is a plan view of a strip dual mode loop resonator according to a first embodiment of a fourth concept.

FIG. 18 is a plan view of a strip loop resonator according to a first embodiment of a fourth concept.

As shown in FIG. 18, a strip loop resonator 181 comprises a pair of parallel coupling lines 182*a*, 182*b* arranged in parallel, a first side connecting line 183 through which first side ends of the parallel coupling lines 182*a*, 182*b* are connected, a second side connecting line 184 through which the other side ends of the parallel coupling lines 182*a*, 182*b* are connected, an input tap coupling line 184 coupled to the first side connecting line 183 in inductive coupling, and an output tap coupling line 185 coupled to the second side connecting line 184 in inductive coupling.

Each of the parallel coupling lines 182*a*, 182*b* has a wide width W1 and an electric length L1, and the parallel coupling lines 182*a*, 182*b* are spaced a narrow distance S1 apart from each other. Therefore, inside portions of the parallel coupling lines 182*a*, 182*b* are strongly coupled to each other in capacitive coupling in cases where microwaves are transmitted in the parallel coupling lines 182*a*, 182*b*.

The first and second side connecting lines 183, 184 have a narrow width W2 and an electric length L2. Both ends of the first side connecting line 183 are connected to outside portions of the parallel coupling lines 182*a*, 182*b* at a first side (or a left side in FIG. 18), and both ends of the second side connecting line 184 are connected to the outside portions of the parallel coupling lines 182*a*, 182*b* at a second side (or a right side in FIG. 18).

Therefore, a rectangular shape of microwave resonator 187 is formed of the parallel coupling lines 182*a*, 182*b* and the first and second side connecting lines 183, 184. An electric length of the microwave resonator 187 sums up to $L_E=2*L1+2*L2$. Also, both ends of the first side connecting line 183 are not coupled to each other so much in cases where microwaves are transmitted in the first side connecting line 183. Also, both ends of the second side connecting line 184 are not coupled to each other so much in the same manner.

In the above configuration, microwaves having various wavelengths around a resonance microwave $\lambda_o$ are transferred from the input tap coupling line 185 to the first side connecting line 183 because the input tap coupling line 185 is coupled to the first side connecting line 183 in the inductive coupling. Thereafter, the microwaves transferred to the line 183 are circulated in the microwave resonator 187 in clockwise and counterclockwise directions, according to the characteristic impedance of the microwave resonator 187. The characteristic impedance of the microwave resonator 187 depends on the electric length $L_E$ of the microwave resonator 187, a line impedance of the microwave resonator 187, and the capacitive coupling between the parallel coupling lines 182*a*, 182*b*. Strength of the capacitive coupling between the parallel coupling lines 182*a*, 182*b* depends on the shape of the parallel coupling lines 182*a*, 182*b* such as the width W1 and the distance S1.

In cases where the wavelength of the microwaves agrees with the resonance wavelength $\lambda_o$ of the microwaves, the microwaves are resonated in the microwave resonator 187. The resonance wavelength $\lambda_o$ of the microwaves resonated in the microwave resonator 187 is longer than the electric length $L_E$ of the microwave resonator 187 because the parallel coupling lines 182*a*, 182*b* are strongly coupled to each other in capacitive coupling. In detail, a resonance frequency $\omega_o$ relating to the resonance wavelength $\lambda_o$, an inductance L, and a capacitance C are generally related according to a resonance equation $\omega_o^2=1/(LC)$. Also, the capacitive coupling between the parallel coupling lines 182*a*, 182*b* is equivalent to a capacitor having the capacitance C. Therefore, the resonance frequency $\omega_o$ is lowered in proportion as the capacitive coupling between the parallel coupling lines 182*a*, 182*b* is stronger. As a result, the resonance wavelength $\lambda_o$ of the microwaves is lengthened by the capacitive coupling between the parallel coupling lines 182*a*, 182*b*.

In addition, an unloaded quality factor Q in a resonance circuit is generally defined according to an equation $Q=\omega_o*C*R$, where the symbol R denotes a resistance in the resonance circuit. Therefore, the unloaded quality factor Q is increased in proportion as the capacitive coupling between the parallel coupling lines 182*a*, 182*b* is stronger. In this case, the unloaded quality factor Q is also generally defined according to an equation $Q=\omega_o/(2*\Delta\omega)$, where the symbol $2*\Delta\omega$ denotes a resonance width of the microwaves resonated in the resonance circuit. Therefore, the resonance width is narrowed in proportion as the capacitive coupling between the parallel coupling lines 182*a*, 182*b* is stronger.

Thereafter, the microwaves resonated in the microwave resonator 187 are transferred to the output tap coupling line 186 because the microwave resonator 187 is coupled to the line 186 in the inductive coupling.

Accordingly, even though the wavelength of the microwaves is longer than the electric length $L_E$ of the microwave resonator 187, the microwaves can be resonated in the strip loop resonator 181. In other words, because the microwaves can be resonated even though the wavelength of the microwaves is longer than the electric length $L_E$, the electric length $L_E$ of the microwave resonator 187 can be shortened. That is, the strip loop resonator 181 can be minimized regardless of the wavelength of the microwaves.

For example, on condition that a relative dielectric constant is at $\epsilon_r=2.2$, a thickness of the microwave resonator 187 is H1=10 mm, the electric length of the parallel coupling lines 182*a*, 182*b* is L1=160 degrees, the electric length of the First and second side connecting lines 183, 184 is L2=20 degrees, a resistance of each of the parallel coupling lines 182*a*, 182*b* is R1=50 Ω, a resistance of each of the first and second side connecting lines 183, 184 is R2=100 Ω, and a pseudo-resonance frequency of the microwaves is $\omega_P=1.0$ GHz, a resonance frequency $\omega_o$ equals $0.992*\omega_P$ in case of a relative distance S1/H1=4. A resonance frequency $\omega_o$ equals $0.98*\omega_P$ in case of a relative distance S1/H1=2. And, a resonance frequency $\omega_o$ equals $0.96*\omega_P$ in case of a relative distance S1/H1=0.2. In cases where the relative dielectric constant $\epsilon_r$ is increased, a ratio of the resonance frequency $\omega_o$ to the pseudo-resonance frequency $\omega_P$ is furthermore reduced because the strength of the capacitive coupling between the parallel coupling lines 182a, 182b is increased.

Also, the resonance wavelength $\lambda_o$ of the microwaves can be minutely adjusted by changing the width W1 of the parallel coupling lines 182a, 182b or the distance S1 between the parallel coupling lines 182a, 182b. The strength of the capacitive coupling between the parallel coupling lines 182a, 182b can be changed by trimming the parallel coupling lines 182a, 182b.

Also, because the unloaded quality factor Q is increased depending on the strength of the capacitive coupling between the parallel coupling lines 182a, 182b, the strip loop resonator 181 in which the resonance width is narrowed can be manufactured.

Also, in cases where the strip loop resonator 181 is utilized as a resonator in an oscillating circuit, an output signal of the oscillating circuit can stably have an oscillated band of which a frequency range is narrowed. Therefore, superior phase-noise characteristics can be obtained in the oscillated circuit in which the strip loop resonator 181 is utilized.

Also, because the strip loop resonator 181 is in rectangular shape, a plurality of resonators 181 can be closely arranged in series.

Next, a second embodiment of the fourth concept according to the present invention is described.

Figure 19:
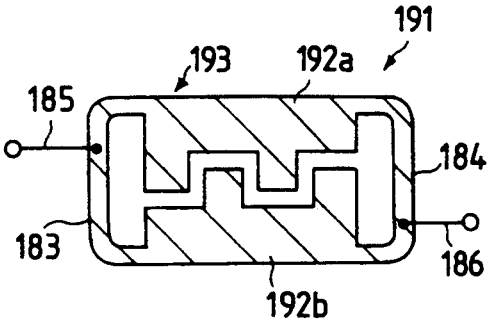
FIG. 19 is a plan view of a strip dual mode loop resonator according to a second embodiment of the fourth concept.

FIG. 19 is a plan view of a strip loop resonator according to a second embodiment of the fourth concept.

As shown in FIG. 19, a strip loop resonator 191 comprises a pair of parallel coupling lines 192a. 192b arranged in parallel, the first side connecting line 183 through which first side ends of the parallel coupling lines 192a, 192b are connected, the second side connecting line 184 through which the other side ends of the parallel coupling lines 192a, 192b are connected, the input tap coupling line 184, and the output tap coupling line 186.

The parallel coupling lines 192a, 192b respectively have a curved inside surface, and the curved inside surfaces of the lines 192a, 192b face each other at the distance S1. Therefore, inside portions of the parallel coupling lines 192a, 192b are strongly coupled to each other in capacitive coupling in cases where microwaves are transmitted in the parallel coupling lines 192a, 192b. Furthermore, the capacitive coupling between the parallel coupling lines 192a, 192b is stronger than that between the parallel coupling lines 182a, 182b because a curved inside surface area of each of the lines 192a, 192b is wider than a straight inside surface area of each of the lines 182a, 182b.

The parallel coupling lines 192a, 192b respectively have the electric length L1 in an outside portion. Therefore, a rectangular shape of microwave resonator 193 is formed of the parallel coupling lines 192a, 192b and the first and second side connecting lines 183, 184. An electric length of the microwave resonator 193 sums up to $L_E=2*L1+2*L2$.

In the above configuration, microwaves having various wavelength around a resonance wavelength $\lambda_o$ are transferred from the input tap coupling line 185 to the first side connecting line 183 in the same manner as in the strip loop resonator 181.

Thereafter, the microwaves transferred to the line 183 are circulated in the microwave resonator 193 in clockwise and counterclockwise directions, according to the characteristic impedance of the microwave resonator 193. The characteristic impedance of the microwave resonator 193 depends on the electric length $L_E$ of the microwave resonator 193, a line impedance of the microwave resonator 193, and the capacitive coupling between the parallel coupling lines 192a, 192b. Strength of the capacitive coupling between the parallel coupling lines 192a, 192b depends on the shape of the parallel coupling lines 192a, 192b such as the distance S1 and the curved inside surfaces of the lines 192a, 192b.

In cases where the wavelength of the microwaves agrees with the resonance wavelength $\lambda_o$ of the microwaves, the microwaves are resonated in the microwave resonator 192. The resonance wavelength $\lambda_o$ of the microwaves resonated in the microwave resonator 192 is longer than the electric length $L_E$ of the microwave resonator 187, in the same reason as in the strip loop resonator 181. Also, a resonance width of the microwaves is narrowed in proportion as the capacitive coupling between the parallel coupling lines 192a, 192b is stronger, in the same reason as in the strip loop resonator 181.

Thereafter, the microwaves resonated in the microwave resonator 193 are transferred to the output tap coupling line 186.

Accordingly, because the capacitive coupling between the parallel coupling lines 192a, 192b is stronger than that between the parallel coupling lines 182a, 182b, the strip loop resonator 191 can be greatly minimized regardless of the wavelength of the microwaves as compared with the strip loop resonator 181.

Also, the resonance wavelength $\lambda_o$ of the microwaves can be minutely adjusted by changing the shape of the curved inside surfaces of the parallel coupling lines 192a, 192b or the distance S1 between the parallel coupling lines 192a, 192b.

Also, the strip loop resonator 191 in which the resonance width is narrowed can be manufactured in the same reason as in the strip loop resonator 181.

Also, in cases where the strip loop resonator 191 is utilized as a resonator in an oscillating circuit, superior phase-noise characteristics can be obtained in the oscillated circuit in which the strip loop resonator 191 is utilized.

Also, because the strip loop resonator 191 is in rectangular shape, a plurality of resonators 181 can be closely arranged in series.

Next, a third embodiment of the fourth concept according to the present invention is described.

Figure 20:
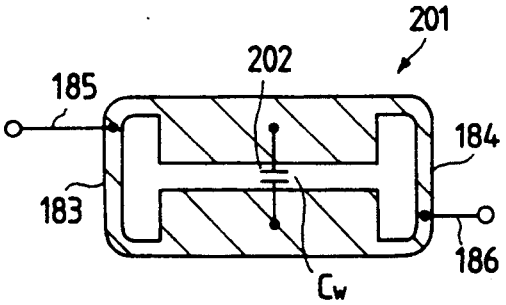
FIG. 20 is a plan view of a strip dual mode loop resonator according to a third embodiment of the fourth concept.

FIG. 20 is a plan view of a strip loop resonator according to a third embodiment of the fourth concept.

As shown in FIG. 20, a strip loop resonator 201 comprises the parallel coupling lines 182a, 182b, the first side connecting line 183, the second side connecting line 184, the input tap coupling line 184, the output tap coupling line 185, and a line-to-line coupling capacitor 202 arranged between the parallel coupling lines 182a, 182b.

The line-to-line coupling capacitor 202 is formed of a plate capacitor or a chip capacitor, and has a lumped capacitance Cw.

In the above configuration, because the line-to-line coupling capacitor 202 is arranged between the parallel coupling lines 182a, 182b, a characteristic impedance in the strip loop resonator 201 is additionally changed by the capacitor 202 as compared with that in the strip loop resonator 181.

Accordingly, the strip loop resonator 201 can be greatly minimized regardless of a wavelength of microwaves as compared with the strip loop resonator 181.

Also, a resonance wavelength $\lambda_o$ of the microwaves can be minutely adjusted by changing the lumped capacitance Cw of the capacitor 202. The lumped capacitance Cw of the capacitor 202 is, for example, changed by trimming both plates of the capacitor 202 after the strip loop resonator 191 is manufactured.

In the third embodiment of the fourth concept, the capacitor 202 is additionally provided to the resonator 181. However, it is preferred that the capacitor 202 be additionally provided to the resonator 191. In this case, the strip loop resonator 201 can be greatly minimized as compared with the strip loop resonator 191.

Also, the capacitor 202 is positioned in the center of each of the parallel coupling lines 182*a*, 182*b*. However, the position of the capacitor 202 is not limited to the center of each of the parallel coupling lines 182*a*, 182*b*. For example, it is preferred that the capacitor 202 be positioned adjacent to the first side connecting line 183 or be positioned adjacent to the second side connecting line 184.

Next, a fourth embodiment of the fourth concept according to the present invention is described.

Figure 21:
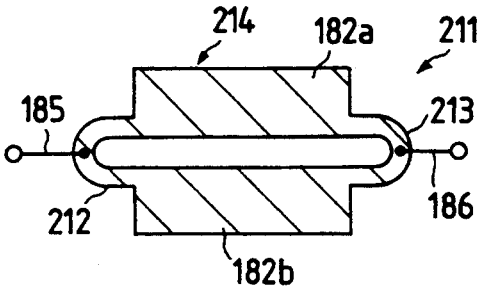
FIG. 21 is a plan view of a strip dual mode loop resonator according to a fourth embodiment of the fourth concept.

FIG. 21 is a plan view of a strip loop resonator according to a fourth embodiment of the fourth concept.

As shown in FIG. 21, a strip loop resonator 211 comprises the parallel coupling lines 182*a*, 182*b*, a first side connecting line 212 through which first side ends of the parallel coupling lines 182*a*, 182*b* are connected, a second side connecting line 213 through which the other side ends of the parallel coupling lines 182*a*, 182*b* are connected, the input tap coupling line 184, and the output tap coupling line 185.

The first and second side connecting lines 212, 213 have the narrow width W2 and an electric length L3. Both ends of the first side connecting line 212 are connected to the inside portions of the parallel coupling lines 182*a*, 182*b* at the first side, and both ends of the second side connecting line 213 are connected to the inside portions of the parallel coupling lines 182*a*, 182*b* at the second side. Therefore, a microwave resonator 214 is formed of the parallel coupling lines 182*a*, 182*b* and the first and second side connecting lines 212, 213. An electric length of the microwave resonator 214 sums up to $L_E=2*L1+2*L3$.

Because the both ends of the first side connecting line 212 are approached to each other, and because the first side connecting line 212 has the narrow width W2, both ends of the first side connecting line 212 are coupled to each other in inductive coupling. Also, both ends of the second side connecting line 213 are coupled to each other in inductive coupling in the same reason.

In the above configuration, a characteristic impedance in the strip loop resonator 211 is additionally changed by the first and second side connecting lines 212, 213 as compared with that in the strip loop resonator 181.

Accordingly, the strip loop resonator 211 can be greatly minimized regardless of a wavelength of microwaves as compared with the strip loop resonator 181.

Next, a fifth embodiment of the fourth concept according to the present invention is described.

Figure 22:
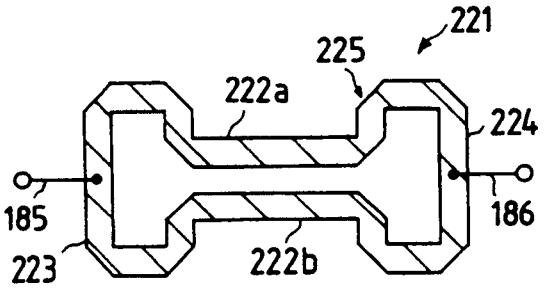
FIG. 22 is a plan view of a strip dual mode loop resonator according to a fifth embodiment of the fourth concept.

FIG. 22 is a plan view of a strip loop resonator according to a fifth embodiment of the fourth concept.

As shown in FIG. 22, a strip loop resonator 221 comprises a pair of parallel coupling lines 222*a*, 222*b*, a C-shaped first side connecting line 223 through which first side ends of the parallel coupling lines 222*a*, 222*b* are connected, a C-shaped second side connecting line 224 through which the other side ends of the parallel coupling lines 222*a*, 222*b* are connected, the input tap coupling line 184, and the output tap coupling line 185.

Each of the parallel coupling lines 222*a*, 222*b* has a narrow width W3 and an electric length L1, and the parallel coupling lines 222*a*, 222*b* are spaced a narrow distance apart. Therefore, the parallel coupling lines 222*a*, 222*b* are coupled to each other in inductive coupling in cases where microwaves are transmitted in the parallel coupling lines 222*a*, 222*b*.

The first and second side connecting lines 223, 224 have the narrow width W3 and an electric length L2. Both ends of the first side connecting line 223 are connected to the parallel coupling lines 222*a*, 222*b* at a first side (or a left side in FIG. 22), and both ends of the second side connecting line 224 are connected to the parallel coupling lines 222*a*, 222*b* at a second side (or a right side in FIG. 22). Therefore, a microwave resonator 225 is formed of the parallel coupling lines 222*a*, 222*b* and the first and second side connecting lines 223, 224. An electric length of the microwave resonator 225 sums up to $L_E=2*L1+2*L2$. Also, both ends of the first side connecting line 223 are not coupled to each other so much in cases where microwaves are transmitted in the first side connecting line 223. Also, both ends of the second side connecting line 224 are not coupled to each other so much in the same manner.

In the above configuration, a characteristic impedance in the strip loop resonator 221 is determined according to the electric length $L_E$ of the microwave resonator 225 and the inductive coupling between the parallel coupling lines 222*a*, 222*b*.

Accordingly, the strip loop resonator 221 can be minimized even though the electric length $L_E$ of the microwave resonator 225 is smaller than a wavelength of the microwaves.

Next, a sixth embodiment of the fourth concept according to the present invention is described.

Figure 23:
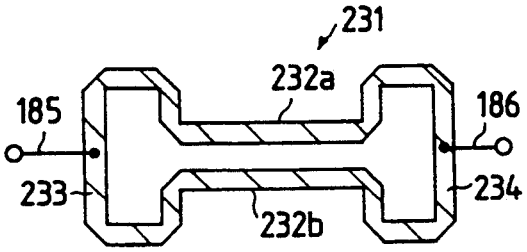
FIG. 23 is a plan view of a strip dual mode loop resonator according to a sixth embodiment of the fourth concept.

FIG. 23 is a plan view of a strip loop resonator according to a sixth embodiment of the fourth concept.

As shown in FIG. 23, a strip loop resonator 231 comprises a pair of parallel coupling lines 232*a*, 232*b*, a C-shaped first side connecting line 233 through which first side ends of the parallel coupling lines 232*a*, 232*b* are connected, a C-shaped second side connecting line 234 through which the other side ends of the parallel coupling lines 232*a*, 232*b* are connected, the input tap coupling line 184, and the output tap coupling line 185.

The parallel coupling lines 232*a*, 232*b* and the first and second side connecting lines 233, 234 respectively have a narrow width W4, so that a microwave resonator 235 having the narrow width W4 is formed of the lines 232*a*, 232*b*, 233, and 234. An electric length of the microwave resonator 235 is the same as that of the microwave resonator 225. The narrow width W4 is narrower than the width W3 of the microwave resonator 225. Therefore, the inductive coupling between the parallel coupling lines 232*a*, 232*b* is stronger than that between the parallel coupling lines 222*a*, 222*b* shown in FIG. 22. In contrast, capacitive coupling between the parallel coupling lines 232*a*, 232*b* is weaker than that between the parallel coupling lines 222*a*, 222*b* shown in FIG. 22.

In the above configuration, a characteristic impedance in the strip loop resonator 231 is determined according to the electric length $L_E$ of the microwave resonator 235 and the inductive coupling between the parallel coupling lines 232*a*, 232*b*, in the same manner as in the resonator 221. Accordingly, the strip loop resonator 231 can be minimized in the same manner as the resonator 221 shown in FIG. 22.

In the fifth to sixth embodiments of the fourth concept, it is preferred that the line-to-line capacitor 202 be additionally provided to the resonator 221 or 222 to strengthen the capacitive coupling between the parallel coupling lines 222*a*, 222*b*, or the parallel coupling lines 232*a*, 232*b*. Also, it is preferred that a pair of curved coupling lines be provided in place of the straight coupling lines on condition that the curved coupling lines are spaced the distance S1 apart.

In the first to sixth embodiments of the fourth concept, the input and output tap coupling lines 183, 186 are respectively coupled to the first and second side connecting lines in the inductive coupling. However, it is preferred that the input and output tap coupling lines 183, 186 be coupled to the first and second side connecting lines in capacitive coupling. Also, it is preferred that the input and output tap coupling lines 183, 186 be coupled to the parallel coupling lines 182*a*, 182*b*, to 232*a*, 232*b*.

Next, a seventh embodiment of the fourth concept according to the present invention is described.

Figure 24:
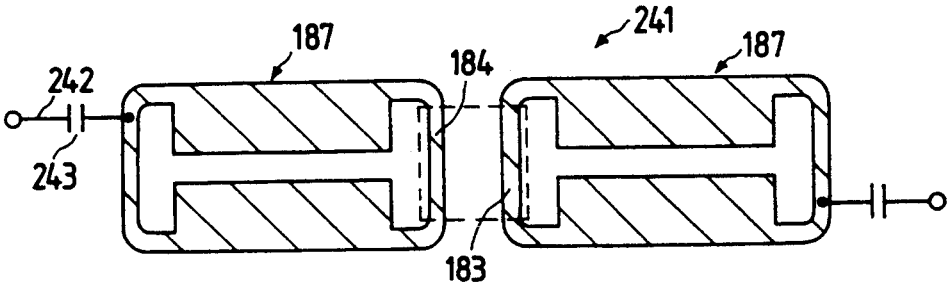
FIG. 24 is a plan view of a band-pass filter in which two microwave resonators shown in FIG. 18 are arranged in series according to a seventh embodiment of the fourth concept.

FIG. 24 is a plan view of a band-pass filter in which two microwave resonators 187 shown in FIG. 18 are arranged in series according to a seventh embodiment of the fourth concept.

As shown in FIG. 24, a band-pass filter 241 according to the seventh embodiment comprises an input strip line 242 in which microwaves are transmitted, the microwave resonator 187 arranged in a first stage, time microwave resonator 187 arranged in a second stage, an input coupling capacitor 243 for coupling the input strip line 242 to the first-stage microwave resonator 187 in capacitive coupling, an output strip line 244 in which the microwaves resonated in the microwave resonators 187 are transmitted, an output coupling capacitor 245 for coupling the output strip line 242 to the second-stage microwave resonator 187 in capacitive coupling.

The second side connecting line 184 of the first-stage microwave resonator 187 is coupled to the first side connecting line 183 of the second-stage microwave resonator 187 in inductive coupling. Because the width W2 of the first and second connecting lines 183, 184 is narrow, a type of the electromagnetic coupling between the first and second connecting lines 183, 184 is the inductive coupling.

In the above configuration, when microwaves are circulated in the first-stage microwave resonator 187, magnetic field is strongly induced around the second connecting line 184 of the first-stage microwave resonator 187 so that microwaves are induced by the magnetic field in the first connecting line 183 of the second-stage microwave resonator 187. Thereafter, the microwaves are circulated in the second-stage microwave resonator 187, and the microwaves are transferred to the output strip line 244. In this case, each of the microwave resonators 187 functions as a resonator and filter. Therefore, the band-pass filter 241 functions as a four-stage filter. Accordingly, because the microwave resonators 187 are in rectangular shape, the microwave resonators 187 can be closely coupled to each other. Also, because a large number of rectangle-shaped microwave resonators 187 can be orderly arranged, the band-pass filter 241 can be minimized even though a large number of rectangle-shaped microwave resonators 187 are arranged in series. Also, a resonance width of the microwaves in a low band is generally narrowed in cases where the microwaves are transferred in the capacitive coupling, and a resonance width of the microwaves in a high band is generally narrowed in cases where the microwaves are transferred in the inductive coupling. In the band-pass filter 241, the input and output strip lines 242, 244 are coupled to the microwave resonators in the capacitive coupling, and the microwave resonators are coupled to each other in the inductive coupling. Therefore, the resonance width of the microwaves can be narrowed regardless of the frequency of the microwaves. In the seventh embodiment of the fourth concept, the microwave resonators 187 are arranged in series. However, the seventh embodiment is not limited to the microwave resonators 187. That is, it is preferred that the microwave resonators 193, 213, 225, or 235 be arranged in series. Next, an eighth embodiment of the fourth concept according to the present invention is described.

Figure 25:
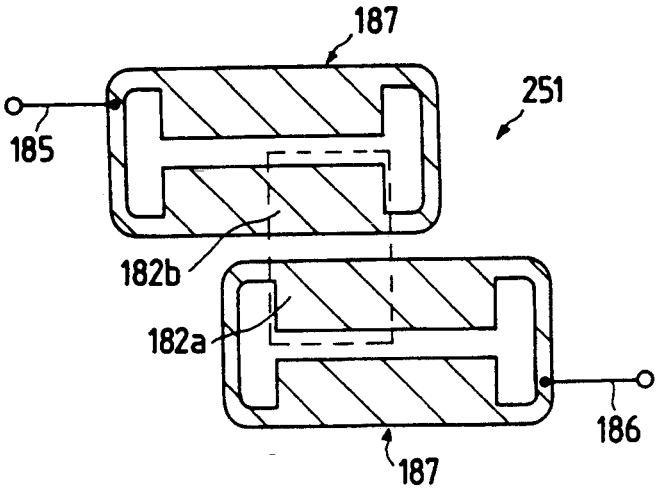
FIG. 25 is a plan view of a band-pass filter in which two microwave resonators shown in FIG. 18 are arranged in series according to an eighth embodiment of the fourth concept.

FIG. 25 is a plan view of a band-pass filter in which two microwave resonators 187 shown in FIG. 18 are arranged in series according to an eighth embodiment of the fourth concept.

As shown in FIG. 25, a band-pass filter 251 according to the seventh embodiment comprises the input tap coupling line 185, the microwave resonator 187 arranged in a first stage, the microwave resonator 187 arranged in a second stage, and the output strip line 186.

The parallel coupling line 182*b* of the first-stage microwave resonator 187 is coupled to the parallel coupling line 182*a* of the second-stage microwave resonator 187 in capacitive coupling. Because the width W1 of the parallel coupling lines 182*a*, 182*b* is wide, a type of the electromagnetic coupling between the parallel coupling lines 182*a*, 182*b* is the capacitive coupling.

In the above configuration, when microwaves are circulated in the first-stage microwave resonator 187, electric field is strongly induced around the parallel coupling line 182*b* of the first-stage microwave resonator 187 so that microwaves are induced by the electric field in the parallel coupling line 182*a* of the second-stage microwave resonator 187. Thereafter, the microwaves are circulated in the second-stage microwave resonator 187, and the microwaves are transferred to the output tap coupling line 186. In this case, each of the microwave resonators 187 functions as a resonator and filter. Therefore, the band-pass filter 251 functions as a four-stage filter.

Accordingly, because the microwave resonators 187 are in rectangular shape, the microwave resonators 187 can be closely coupled to each other. Also, because a large number of rectangle-shaped microwave resonators 187 can be orderly arranged, the band-pass filter 251 can be minimized even though a large number of rectangle-shaped microwave resonators 187 are arranged in series.

Also, the input and output tap coupling lines 185, 186 are coupled to the microwave resonators 187 in the inductive coupling, and the microwave resonators 187 are coupled to each other in the capacitive coupling. Therefore, a resonance width of the microwaves can be narrowed regardless of the frequency of the microwaves in the band-pass filter 251.

In the eighth embodiment of the fourth concept, the microwave resonators 187 are arranged in series. However, the eighth embodiment is not limited to the microwave resonators 187. That is, it is preferred that the microwave resonators 193, 213, 225, or 235 be arranged in series.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A strip dual mode loop resonator in which a microwave is resonated, comprising:

loop-shaped strip line having a pair of parallel lines arranged in parallel to each other, an electric line length of the loop-shaped strip line being equivalent to a wavelength of the microwave to resonate the microwave circulated in the loop-shaped strip line in two different directions according to a characteristic impedance of the loop-shaped strip line, and the parallel lines being coupled to each other in electromagnetic coupling to change the characteristic impedance of the loop-shaped strip line;

an input strip line in which the microwave is transmitted;

an input impedance element for coupling the input strip line to the loop-shaped strip line in electromagnetic coupling to transfer the microwave from the input strip line to an input point of the loop-shaped strip line;

an output strip line in which the microwave resonated in the loop-shaped strip line is transmitted; and an output impedance element for coupling the output strip line to the loop-shaped strip line in electromagnetic coupling to transfer the microwave from an output point of the loop-shaped strip line to the output strip line, the output point being spaced a quarter of the wavelength of the microwave apart from the input point.

2. A resonator according to claim 1, the strip dual mode loop resonator additionally includes a line-to-line impedance element arranged between the parallel lines of the loop-shaped strip line for changing the characteristic impedance of the loop-shaped strip line, a first electric line length between the input point and one end of the line-to-line impedance element connected to one of the parallel lines being equal to a second electric length between the output point and another end of the line-to-line impedance element connected to the other parallel line.

3. A resonator according to claim 2 in which the first and second electric line lengths are equal to a quarter of the wavelength of the microwave.

4. A resonator according to claim 1 in which the loop-shaped strip line has a rectangular shape, and four corners of the loop-shaped strip line are cut off.

5. A resonator according to claim 1, the strip dual mode loop resonator additionally includes a capacitor having a variable capacitance for changing the characteristic impedance of the loop-shaped strip line, one end of the capacitor being connected to a connecting point of the loop-shaped strip line spaced a three-eighth of the wavelength of the microwave apart from the input and output points of the loop-shaped strip line, and another end of the capacitor being grounded.

6. A resonator according to claim 1, the strip dual mode loop resonator additionally includes an open end stub for reflecting the microwave to change the characteristic impedance of the loop-shaped strip line, the open end stub being spaced a three-eighth of the wavelength of the microwave apart from the input and output points of the loop-shaped strip line, and intensity of the microwave reflected by the open end stub being changed by trimming the open end stub.

7. A resonator according to claim 1 in which the input impedance element is an input coupling capacitor for coupling the input strip line to the loop-shaped strip line in capacitive coupling, and the output impedance element is an output coupling capacitor for coupling the output strip line to the loop-shaped strip line in capacitive coupling.

8. A resonator according to claim 1 in which the input impedance element is an input magnetic coupling line for coupling the input strip line to the loop-shaped strip line in magnetic coupling, and the output impedance element is an output magnetic coupling line for coupling the output strip line to the loop-shaped strip line in magnetic coupling.

9. A resonator according to claim 2 in which the line-to-line impedance element is a capacitor having a lumped capacitance.

10. A resonator according to claim 2 in which the line-to-line impedance element is a coupling capacitor having a distributed capacitance.

11. A resonator according to claim 2 in which the line-to-line impedance element is an inductor having a lumped inductance.

12. A resonator according to claim 1 in which the loop-shaped strip line and the input and output strip lines are respectively formed of a microstrip.

13. A resonator according to claim 1 in which the loop-shaped strip line and the input and output strip lines are respectively formed of a balanced strip line.

14. A band-pass filter for filtering a microwave, comprising:

a plurality of loop-shaped strip lines arranged in series, each of the loop-shaped strip lines having an input point, an output point, and a pair of parallel lines arranged in parallel to each other, an electric line length of each of the loop-shaped strip lines being equivalent to a wavelength of the microwave to resonate the microwave circulated in each of the loop-shaped strip lines in two different directions according to a characteristic impedance of each of the loop-shaped strip lines, and the parallel lines of each of the loop-shaped strip lines being coupled to each other in electromagnetic coupling to change the characteristic impedance of each of the loop-shaped strip lines;

an input strip line in which the microwave is transmitted;

an input impedance element for coupling the input strip line to the loop-shaped strip line arranged in a first stage in electromagnetic coupling to transfer the microwave from the input strip line to an input point of the first-stage loop-shaped strip line;

a plurality of inter-stage impedance elements which are each arranged between an adjacent pair of upper and lower stage loop-shaped strip lines, one end of each of the inter-stage impedance elements being coupled to an output point of the upper stage loop-shaped strip line, the opposite end of each of the inter-stage impedance elements being coupled to an input point of the lower stage loop-shaped strip line, wherein the output point of each of the loop-shaped strip lines is spaced a quarter of the wavelength of the microwave apart from the input point thereof;

an output strip line in which the microwave resonated in the loop-shaped strip lines is transmitted; and an output impedance element for coupling the output strip line to the output point of the loop-shaped strip line arranged in a final stage in electromagnetic coupling to transfer the microwave from the output point of the final-stage looped strip line to the output strip line.

15. A filter according to claim 14, each of the loop-shaped strip lines additionally includes a line-to-line impedance element arranged between the parallel lines of the loop-shaped strip line for changing the characteristic impedance of the loop-shaped strip line, a first electric line length between the input point and one end of the line-to-line impedance element connected to one of the parallel lines being equal to a second electric length between the output point and another end of the line-to-line impedance element connected to the other parallel line.

16. A resonator according to claim 1 wherein the electromagnetic coupling between said parallel lines of the loop-shaped strip line is provided in accordance with a distance between said parallel lines, a height of said parallel lines and a width of said parallel lines.

17. A filter according to claim 14 wherein the electromagnetic coupling between said parallel lines of each of said loop-shaped strip lines corresponds to a distance between said parallel lines, a height of said parallel lines and a width of said parallel lines.

* * * * *